US006386078B1

(12) United States Patent
Wu

(10) Patent No.: US 6,386,078 B1
(45) Date of Patent: May 14, 2002

(54) SCREWDRIVER FOR OPERATING SELF-TIGHTENING SCREW

(76) Inventor: Shu Te Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 09/512,054

(22) Filed: Feb. 24, 2000

(30) Foreign Application Priority Data

Mar. 30, 1999 (TW) ..... 088105172
Aug. 14, 1999 (TW) ..... 088114010

(51) Int. Cl.[7] ..... B25B 19/00
(52) U.S. Cl. ..... 81/463; 173/121
(58) Field of Search ..... 81/463; 173/90, 173/121; 29/254, 275

(56) References Cited

U.S. PATENT DOCUMENTS 3,366,187 A * 1/1968 Von Tersch ..... 173/93.6
3,435,862 A * 4/1969 Rainey ..... 81/463
3,783,956 A * 1/1974 Schultz ..... 173/93.7
3,900,058 A * 8/1975 McArdle ..... 81/463
4,708,209 A * 11/1987 Aspinwall ..... 173/93
5,012,709 A * 5/1991 Su ..... 81/466
5,321,999 A * 6/1994 Lin ..... 81/463
6,250,187 B1 * 6/2001 Ju et al. ..... 81/463

* cited by examiner

*Primary Examiner*—Joseph J. Hail, III
*Assistant Examiner*—David B. Thomas
(74) *Attorney, Agent, or Firm*—Troxell Law Office PLLC

(57) ABSTRACT

Screwdriver for operating self-tightening screw, including a grip; a striking mechanism disposed in the grip for providing a striking force; and a stem body slidably disposed in the grip. The top end of the stem body is drivingly engaged with the striking mechanism. The bottom end of the stem body serves to drive the self-tightening screw. In use, the screwdriver is pressed downward against the self-tightening screw. At this time, the stem body is slided into the grip to drivingly move the striking mechanism. The striking mechanism produces a striking force acting on the self-tightening screw so as to nail the self-tightening screw into a screwing position of a work piece. Then the screwdriver is used to screw the self-tightening screw into the work piece.

51 Claims, 23 Drawing Sheets

SCREWDRIVER FOR OPERATING SELF-TIGHTENING SCREW

BACKGROUND OF THE INVENTION

The present invention relates to a screwdriver, and more particularly to a screwdriver for operating self-tightening screw. The screwdriver is able to first nail the self-tightening screw into a screwing position of a work piece and then further screw the self-tightening screw into the work piece.

In a DIY product, self-tightening screws are often used to connect work pieces with each other, such as wooden slats.

The self-tightening screw is driven by a screwdriver to screw into a work piece. Prior to screwing the self-tightening screw, the tip of the self-tightening screw must be first nailed into the work piece. There are generally two measures for nailing the tip of the self-tightening screw into the work piece. One is to use a hammering tool to strike and nail the self-tightening screw in to the work piece. The other is to directly use the screwdriver to exert an axial force onto the self-tightening screw and simultaneously drive the self-tightening screw into the work piece. With respect to the first measure, an operator must pinch the self-tightening screw with one hand and at the same time operate the hammering tool to strike the self-tightening screw with the other hand so as to nail the self-tightening screw into the work piece. During the striking operation, it often takes place that the hammering tool incautiously hits and injures the hand pinching the self-tightening screw. With respect to the second measure, the pressure exerted by the operator onto the self-tightening screw is not so direct and effective as the pressure produced by the hammering tool so that it is laborious for the operator to effectively press the self-tightening screw against the work piece. Moreover, the tip of the self-tightening screw contacts with the work piece at a point with small area so that the self-tightening screw contacts with the work piece in an unstable state and tends to deflect and can be hardly located on the work piece. Therefore, during operation, it often takes place that the screwdriver slips away from the self-tightening screw and the self-tightening screw bounds away to other place. Therefore, it is necessary to repeat the operation many times for nailing the self-tightening screw into the work piece.

SUMMARY OF THE INVENTION

It is therefore a primary object of the present invention to provide a screwdriver for operating self-tightening screw. The screwdriver is able to first nail the self-tightening screw into a work piece to facilitate the screwing of the self-tightening screw.

It is a further object of the present invention to provide a screwdriver for operating self-tightening screw, which is able to first nail the self-tightening screw into work piece without using any other tool and pinching the screw with a hand so that the user's hand is protected from being hit and injured.

It is still a further object of the present invention to provide a screwdriver for operating self-tightening screw, by which during the nailing of the self-tightening screw, the screw will not deflect or randomly bound away.

It is still a further object of the present invention to provide a screwdriver for operating self-tightening screw, which enables a user to quickly and conveniently nail a self-tightening screw.

The present invention can be best understood through the following description and accompanying drawings wherein:

DETAILED DESCRIPTION OF THE PREFERRED EMBODIMENTS

Figure 1:
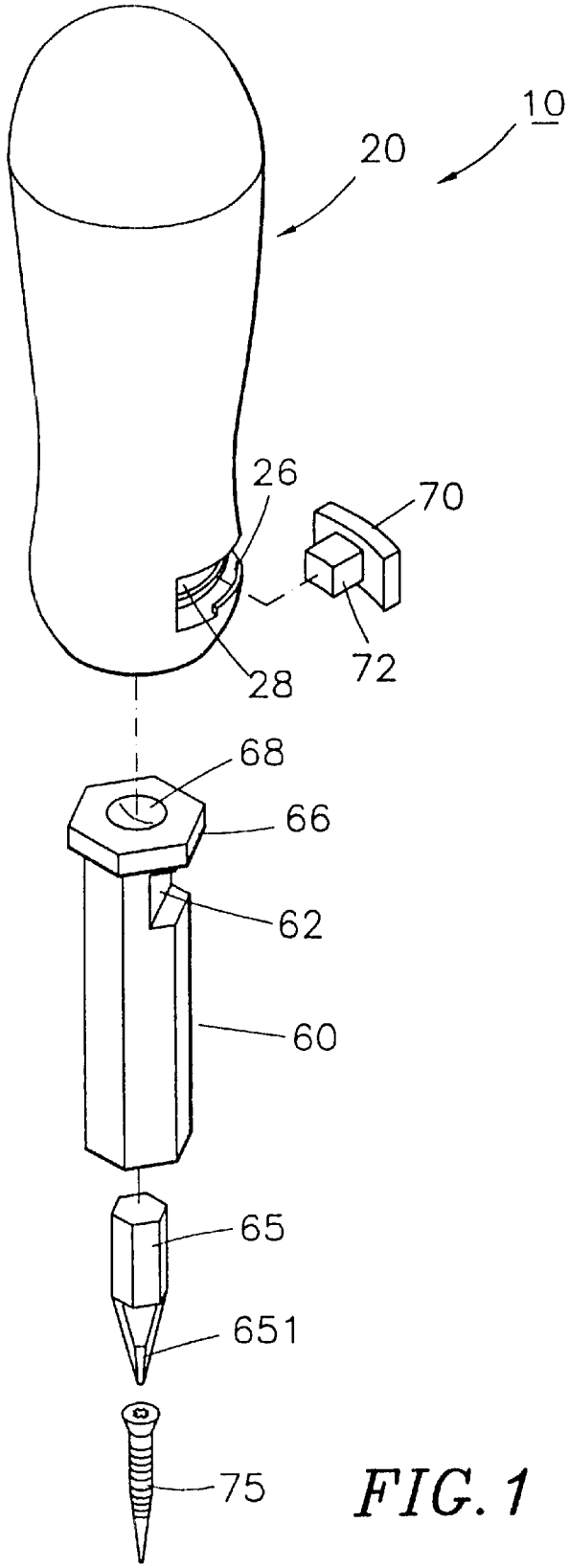
FIG. 1 is a perspective exploded view of a first embodiment of the present invention.
Figure 2:
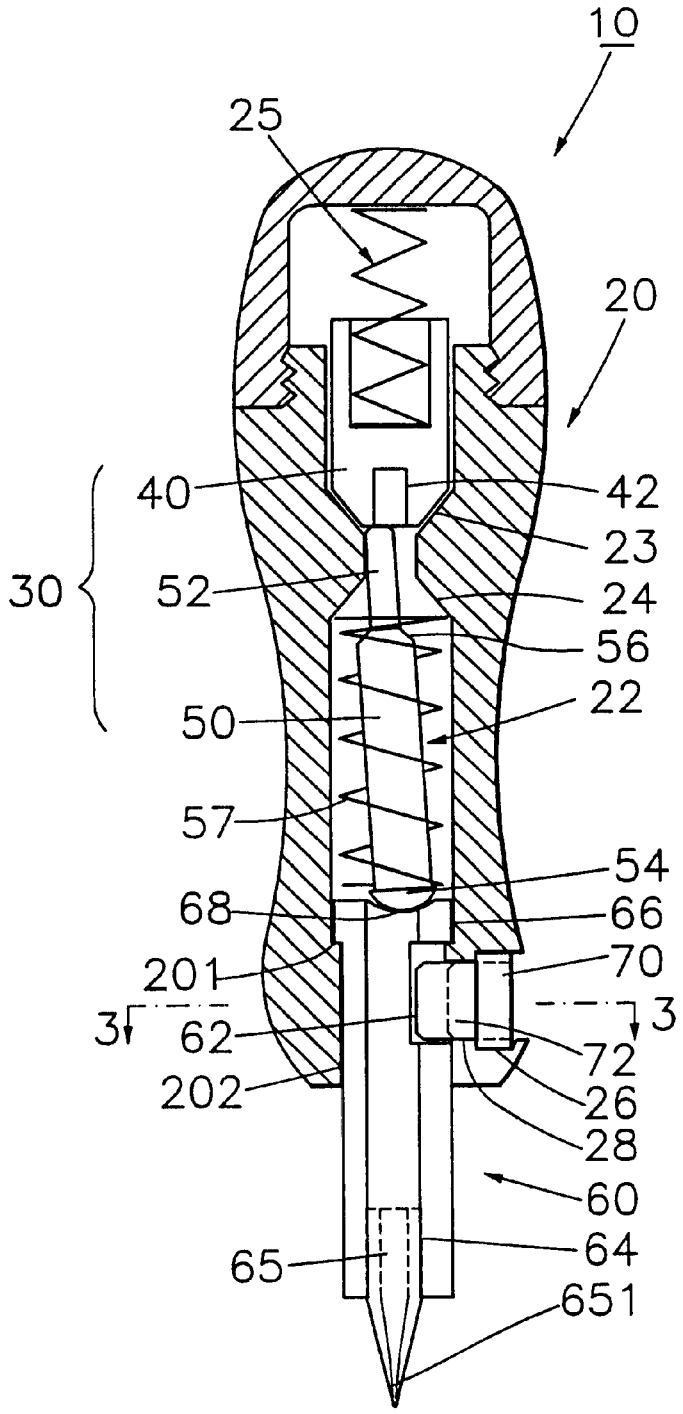
FIG. 2 is a sectional assembled view of the first embodiment of FIG. 1.

Please first refer to FIGS. 1 and 2. According to a first embodiment of the present invention, the screwdriver 10 includes:

a grip 20 for a user to hold, the grip 20 being formed with an axial passage 22 passing through a bottom end of the grip; and a striking mechanism having a resilient energy-reserving member 25 and a striking assembly 30 and disposed in the passage 22 for providing a striking force. The resilient energy-reserving member 25 has a relatively great coefficient of resilience.

The striking assembly 30 includes:

a hammering body 40 which is a column-like metal body, a bottom end of the hammering body 40 being formed with an inward extending shaft hole 42, the hammering body 40 being slidably received in the passage 22, one end of the energy-reserving member 25 abutting against the inner wall of the passage, while the other end thereof abutting against the hammering body for downward pushing the hammering body, when the hammering body 40 is not subject to external force, the hammering body 40 being kept located at a locating section 23 of the passage 22;

a hammering bar 50, a top end of the hammering bar 50 being a rod section 52 with smaller diameter, while a bottom end of the hammering bar 50 being a striking section 54, a body of the hammering bar 50 between the rod section 52 and the striking section 54 being formed with a conic guide sect ion 56 having an upward tapered outer diameter, the hammering bar 50 being slidably received in the passage 22 under the hammering body 40, the maximum outer diameter of the body of the hammering bar being smaller than the inner diameter of the passage 22 so that in a normal state, the hammering bar will naturally tilt and an angle is contained by the axes of the hammering bar 50 and the passage 22, in this embodiment, the passage being formed with a rectifying section 24 under the locating section 23 corresponding to the guide section 56 for rectifying the hammering bar;

a resilient member 57 having less coefficient of resilience and fitted around the hammering bar 50, one end of the resilient member 57 abutting against the inner wall of the passage, while the other end thereof abutting against the hammering bar, whereby when not subject to external force, the hammering bar is kept sliding downward and the rod section 52 is prevented from extending into the shaft hole 42; and a stem body 60, in this embodiment, the stem body 60 having a polygonal cross-section, an inner side of the top end of the stem body 60 being formed with a recessed stop section 62, a bottom end thereof being formed with a hexagonal socket 64 for fitting with a screwdriver head 65 having a driving section 651. Different screwdriver heads can be replaceably fitted in the socket 64. The top end of the stem body is slidably fitted into the passage 22. The top end of the stem body is formed with a stop: sect ion 66 engaged with an engaging section 201 formed on the inner wall of the passage, serving as a lower stop point of the sliding of the stem body for preventing the stem body from dropping out. The bottom end of the hammering bar 50 abuts against the stem body to locate the hammering bar 50. The top face of the stem body 60 is formed with an eccentric concave 68 or convex, whereby when the arched striking section 54 contacts with the concave 68, the hammering bar 50 will be surely deflected. However, the concave 68 is omissible. The hammering bar will still naturally tilt without the concave.

The bottom end of the passage 22 is formed with a hole 202 having a shape identical to that of the cross-section of the stem body 60, whereby a torque can be transmitted from the grip 20 to the stem body 60.

A stop member 70 which can have various patterns such as a ring body fitted on the circumferential face of the grip for a user's hand to rotate. Alternatively, the stop member 70 can be an arched plate body as shown in FIG. 1. The pattern of the stop member is not limited to the pattern of this embodiment. The stop member 70 has an engaging section 72 and is disposed at a mounting section 26 formed on the circumferential face of the bottom end of the grip 20 for a user's hand to shift between two positions. The engaging section 72 extends from a window 28 into the passage 22 corresponding the stop section 62 of the stem body 60 for engaging with the stop section 62. When the stop member 70 is shifted to one of the two positions, the engaging section 72 is engaged with the stop section 62 to prevent the stem body from sliding toward the passage.

When shifted to the other position, the engaging section is disengaged from the stop section, permitting the stem body to slide iwnard the passage.

Figure 4:
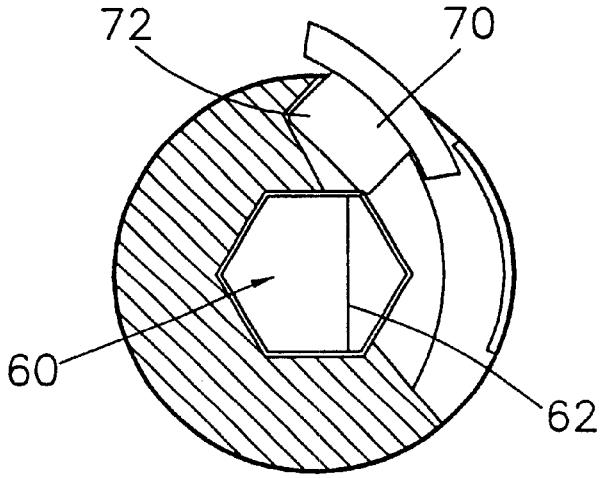
FIG. 4 is a sectional view according to FIG. 3, showing another relationship between the stop member and the stem body.

The present invention provides a preceding operation prior to screwing the self-tightening screw into a screwing position of the work piece. Before the self-tightening screw 75 is screwed, the stop member 70 is first shifted to the second position as shown in FIG. 4, making the engaging section 72 disengaged from the stop section 62 of the stem body 60. Then the driving section 651 at front end of the stem body is fitted with the head 76 of the self-tightening screw 75 as shown in FIG. 5 with the tip of the self-tightening screw pressed against the surface of the work piece.

Figure 6:
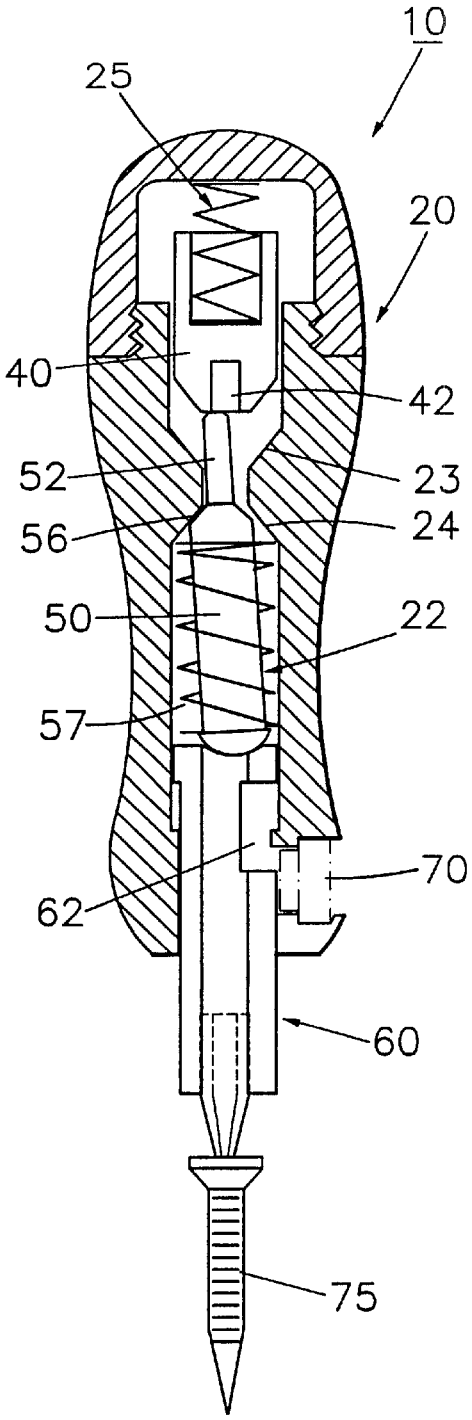
FIG. 6 is a view according to FIG. 5, showing a state in the instant prior to striking the screw.

Thereafter, the operator downward presses the screwdriver. At this time, the self-tightening screw 75 and the stem body 60 will suffer a reaction force to slide into the passage 22. The hammering bar 50 and the hammering body 40 are driven to slide toward the top end of the passage 22 as shown in FIG. 6. At this time, the energy-reserving member 25 is compressed to reserve a resilient energy. In a normal state, the hammering bar is tilted so that when the hammering bar pushes the hammering body, the top end of the rod section 52 abuts against the bottom face of the hammering body 40 without inserting into the shaft hole 42.

Figure 7:
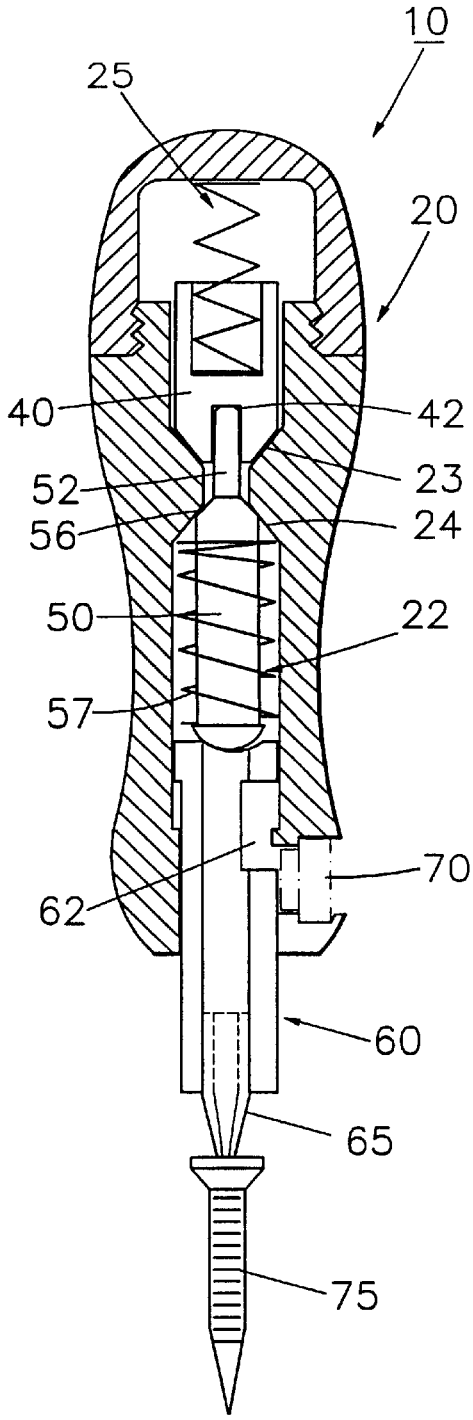
FIG. 7 is a view according to FIG. 6, showing that the screw is struck.

When the operator continuously exerts a force, the members 60, 50, 40 are further moved inward so that the resilient energy reserved in the energy-reserving member 25 is gradually increased. When the guide section 56 of the hammering bar 50 contacts with the rectifying section 24, the hammering bar is guided by the rectifying section 24 to gradually deflect to an upright position. At this time, the rod section 52 is gradually aligned with the shaft hole 42. In the instant of alignment of the rod section with the shaft hole, the hammering body 40 is free from the pushing force of the hammering bar 50 and the hammering bar is inserted into the hammering body. In this instant, the hammering body is temporarily suspended and the resilient energy of the energy-reserving member 25 is instantaneously released to act on the hammering body. At this time, the hammering body instantaneously strikes the hammering bar 50 as shown in FIG. 7. The impacting force is transmitted from the hammering bar 50 to the stem body 60, making the tip of the self-tightening screw 75 nail into the screwing position of the work piece.

Figure 5:
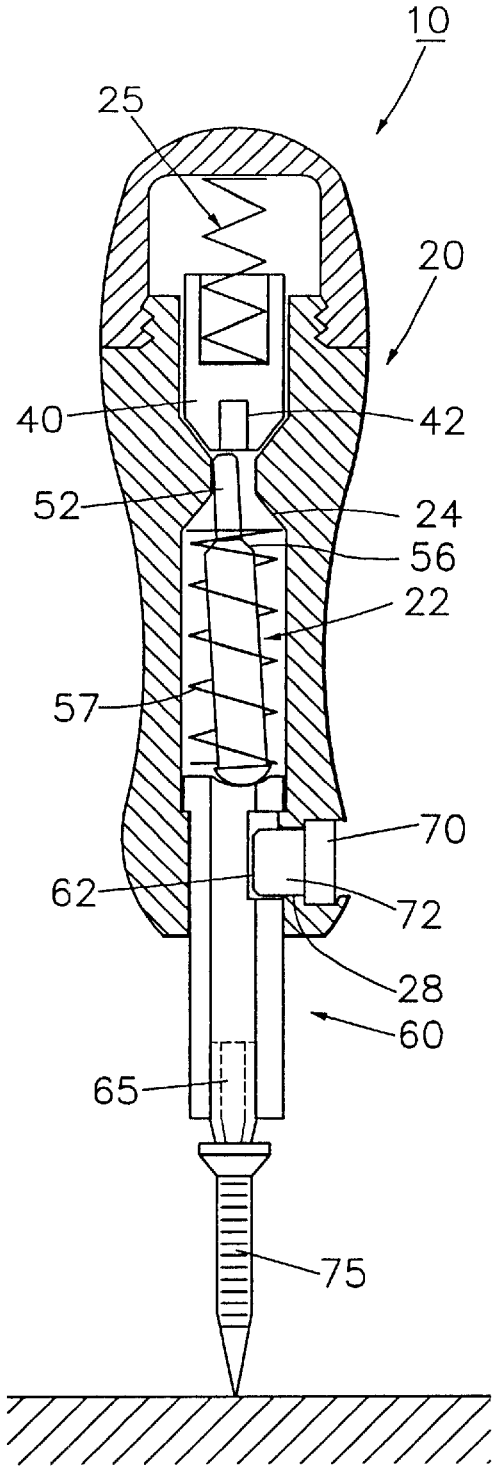
FIG. 5 shows that a self-tightening screw is to be nailed into a work piece by the screwdriver of the present invention.

When the screwdriver is released from the pressing force, the energy-reserving member 25 restores the hammering body 40 to the locating section 23 and the resilient member 57 downward pushes the hammering bar 50, making the rod section 52 separate from the shaft hole 42 into a state as shown in FIG. 5.

The operation of FIGS. 5 to 7 is repeated several times so as to truly and fixedly nail the tip of the self-tightening screw 75 into the work piece by a certain depth.

Figure 3:
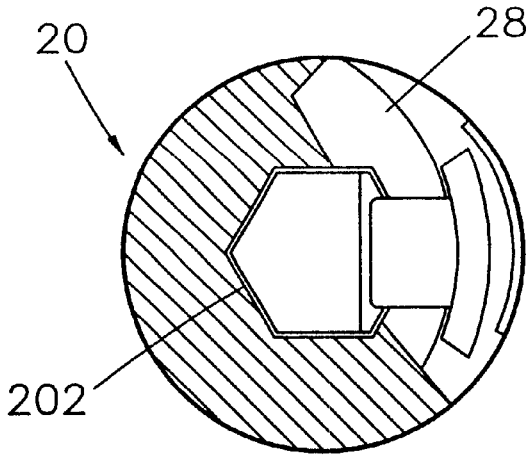
FIG. 3 is a sectional view taken along line 3—3 of FIG. 2, showing a relationship between the stop member and the stem body.

After the self-tightening screw 75 is nailed, the stop member 70 is shifted to the first position as shown in FIG. 3 and the stop section 62 of the stem body 60 is engaged with the engaging section 72 of the stop member 70. At this time, the stem body is located and prevented from sliding into the passage and restored to a state as shown in FIG. 2. Then, the screwdriver 10 can be used to screw the self-tightening screw 75. The torque is transmitted from the grip to the stem body so that the self-tightening screw 75 can be smoothly screwed into the work piece.

It should be noted that in the embodiment of FIG. 2, the transmission of torque between the grip and the stem body is achieved by the hole 202 and the stem body 60 having polygonal cross-section. However, the transmission of torque can be achieved otherwise. For example, the engaging section 72 can be engaged with the stop section 62 to provide a transmission effect for the torque. Accordingly, the stem body and the hole 202 is no more necessary to suffer any torque.

Furthermore, in the structure of FIG. 2, the stop member 70 serves to locate the stem body and prevent the stem body from retracting so as to drive the self-tightening screw. However, the energy-reserving member 25 has greater resilient energy so that the stem body is uneasy to retract and slide inward. Therefore, even if the stop member is omitted, the screwdriver 10 can still drive the self-tightening screw with the stem body.

Figure 8:
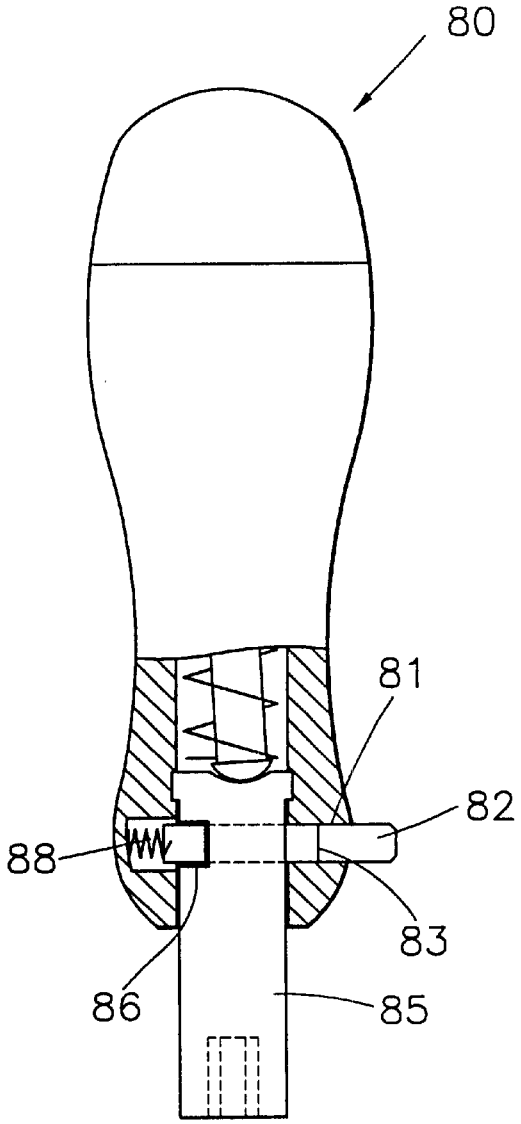
FIG. 8 is a front partially sectional view of a second embodiment of the present invention.

FIG. 8 shows another embodiment of the present invention, in which the stop member 82 is a rod member formed with a through hole as an engaging section 83. One end of the stop member 82 extends from the window 81 into the grip 80, while the other end thereof protrudes outside the grip and is radially slidable. The stem body 85 is passed through the engaging section 83. A resilient member 88 is compressed between the grip and the stop member 82 for resiliently pushing the stop member outward in a not forced state. Therefore, the engaging section 83 is engaged with the stop section 86 of the stem body 85.

As shown in FIG. 8, when the stop member 82 is positioned at the first position, the stem body is engaged and located for driving the self-tightening screw.

Figure 9:
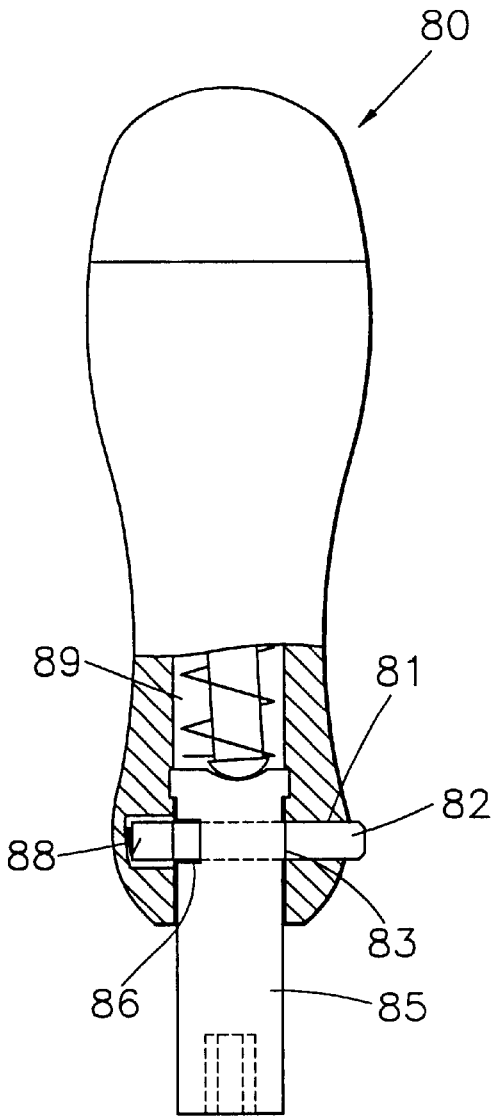
FIG. 9 is a view according to FIG. 8, showing the striking state of the second embodiment.

When an operator presses the stop member and makes it move to the second position as shown in FIG. 9, the engaging section 83 is aligned with the stem body 85 and the stem body 85 is disengaged. At this time, the stem body can slide toward the passage 89 into a state for striking the self-tightening screw.

Figure 10:
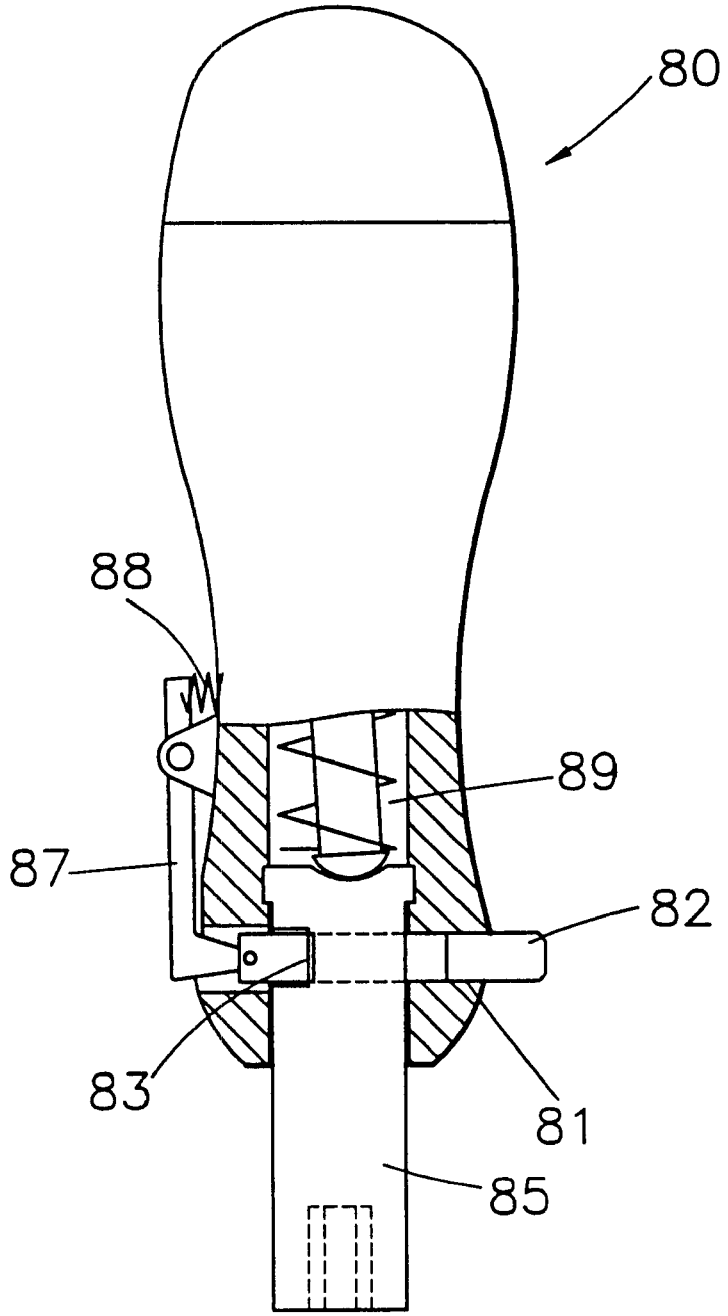
FIG. 10 is a partially sectional view of a third embodiment of the present invention.

FIG. 10 shows still another embodiment of the present invention, in which the grip 80 is formed with a radial cut 81. This embodiment further includes a pressing lever 87 the body of which is pivotally connected to the circumferential face of the grip 80. One end of the pressing lever 87 is connected with the stop member 82 for driving the stop member to slide. This embodiment further includes a resilient member 88 disposed between the pressing lever 87 and the grip. When not subject to external force, the resilient member 88 serves to resiliently make the pressing lever 87 keep the stop member 82 at the first position for engaging with and locating the stem body.

When the stop member 82 is positioned at the first position, the engaging section 83 is not aligned with the stem body 85 and the passage 89 so that the stem body is engaged and located for driving the self-tightening screw.

When the operator presses the pressing lever 87 and drives the stop member 82 to slide to the second position, the engaging section 83 is aligned with the stem body and disengaged from the stem body. At this time, the stem body can slide toward the passage 89 for striking the self-tightening screw.

Figure 11:
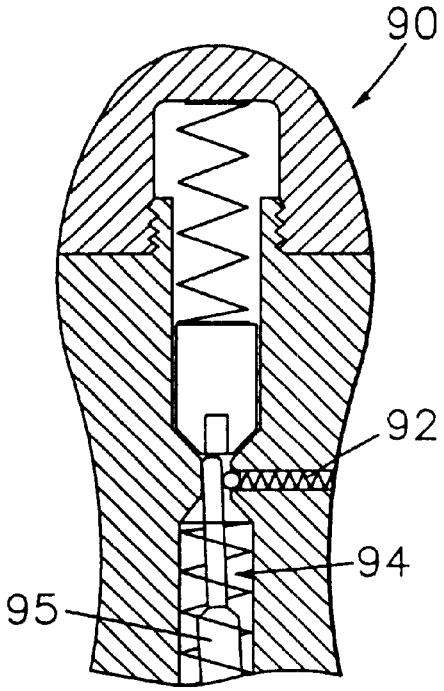
FIG. 11 is a partially sectional view of a fourth embodiment of the present invention.
Figure 12:
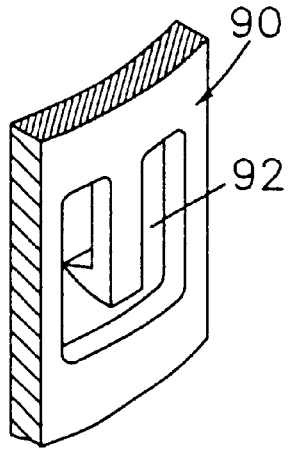
FIG. 12 is a partially sectional view of,a fifth embodiment of the present invention.

FIGS. 11 and 12 shows two other embodiments of the present invention, in which a tilting member 92 is disposed in the grip 90. In FIG. 11, the tilting member is a resilient member extending into the passage 94 for pushing the hammering bar 95, whereby the hammering bar 95 is kept tilted before rectified. The tilting member 92 of the FIG. 11 can be a spring disposed in the grip. In FIG. 12, the tilting member 92 is a resilient rib integrally formed with the grip 90 for pushing the hammering bar.

Figure 13:
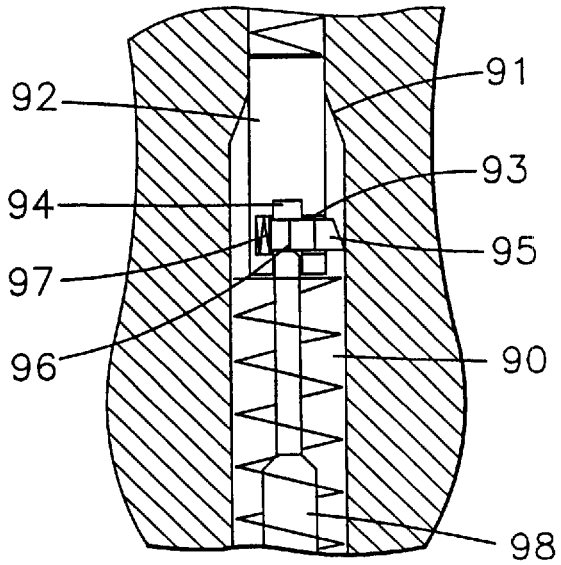
FIG. 13 is a partially sectional view of a sixth embodiment of the present invention.

FIG. 13 shows still another embodiment of the present invention, in which the passage 90 is free from the locating section as the first embodiment. The rectifying section 91 is positioned at a height of the hammering body 92. The inner side of the bottom end of the hammering body 92 is formed with a radial tunnel 93 communicating with the shaft hole 94. An aligning member 95 is slidably fitted in the tunnel 93. The body of the aligning member 95 is formed with a hole 96 corresponding to the shaft hole 94. The aligning member is positioned under the rectifying section 91 by a predetermined distance. A resilient member 97 is disposed in the tunnel 93 for pushing the aligning member 95 and making one end thereof protrude out of the hammering body in a not forced state. Also, the hole 96 is disaligned from the shaft hole 94. The rod section 99 of the hammering bar 98 extends into the shaft hole 94 and abuts against the aligning member 95.

Figure 14:
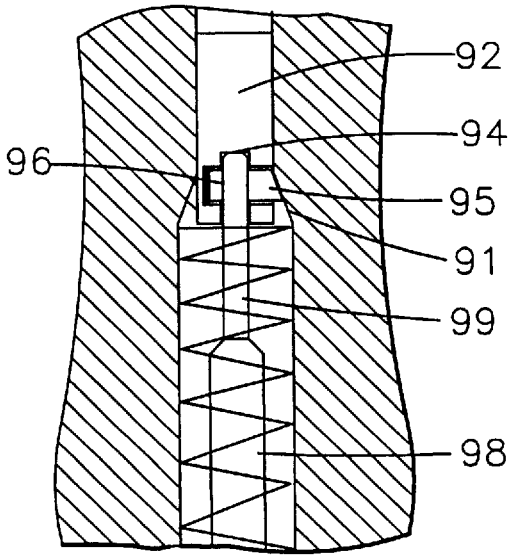
FIG. 14 is a view according to FIG. 13, showing the striking state of the sixth embodiment of the present invention.

In operation, when the hammering bar 98 and the hammering body 92 suffer external force and move inward, the protruding end of the aligning member 95 contacts with the rectifying section 91 and is guided thereby to move inward along the tunnel 93. In the instant of aligning of the hole 96 with the shaft hole 94, the rod section 99 of the hammering bar 98 is totally aligned with the hole 96 without abutting against the aligning member. In this instant, the hammering body 92 is disengaged from the hammering bar and the hammering body 92 is driven by the resilient energy of the energy-reserving member to strike the hammering bar as shown in FIG. 14. At this time, the self-tightening screw suffers a striking force and is nailed into the screwing position.

Figure 15:
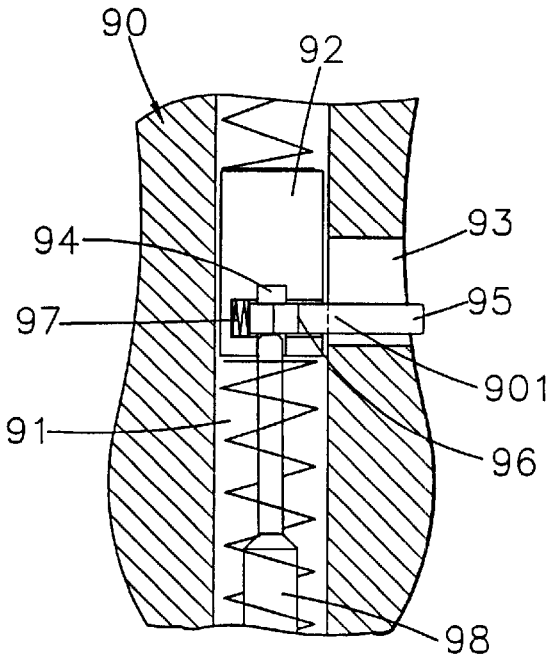
FIG. 15 is a partially sectional view of a seventh embodiment of the present invention.

FIG. 15 shows another embodiment which is different from the embodiment of FIG. 13 in that the passage 91 of the grip 90 is not disposed with the rectifying section and the circumferential wall of the passage 91 is formed with a slot 93 corresponding to the up and down travel of the aligning member 95. The protruding end of the aligning member 95 protrudes from the slot 93 out of the grip for a user's hand to press. In a normal state, the aligning member 95 is pushed by the resilient member 97 to disalign the hole 96 from the shaft hole 94. The aligning member 95 is disposed with an engaging section engaged with the grip 90. The engaging section can be a stepped engaging section 901 for preventing the aligning member 95 from dropping out of the grip.

Figure 16:
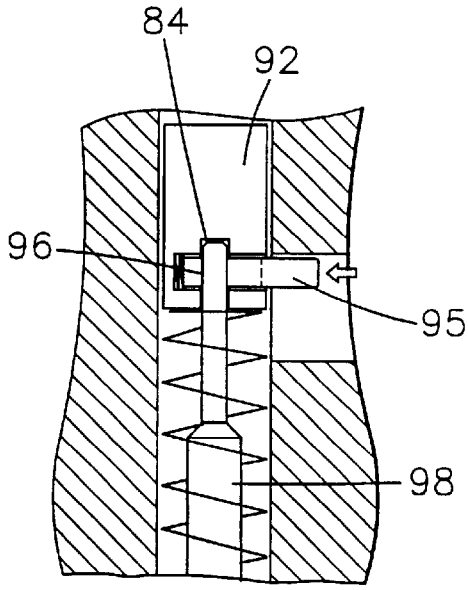
FIG. 16 is a view according to FIG. 15, showing the striking state of the seventh embodiment of the present invention.

In operation, when the hammering bar 98 and the hammering body 92 suffer external force and upward slide in a direction as shown in the drawings, the energy-reserving member reserves a resilient energy. Thereafter, the operator can inward press the aligning member 95 to align the hole 96 with the shaft hole 94 so as to provide a striking effect as shown in FIG. 16.

Figure 17:
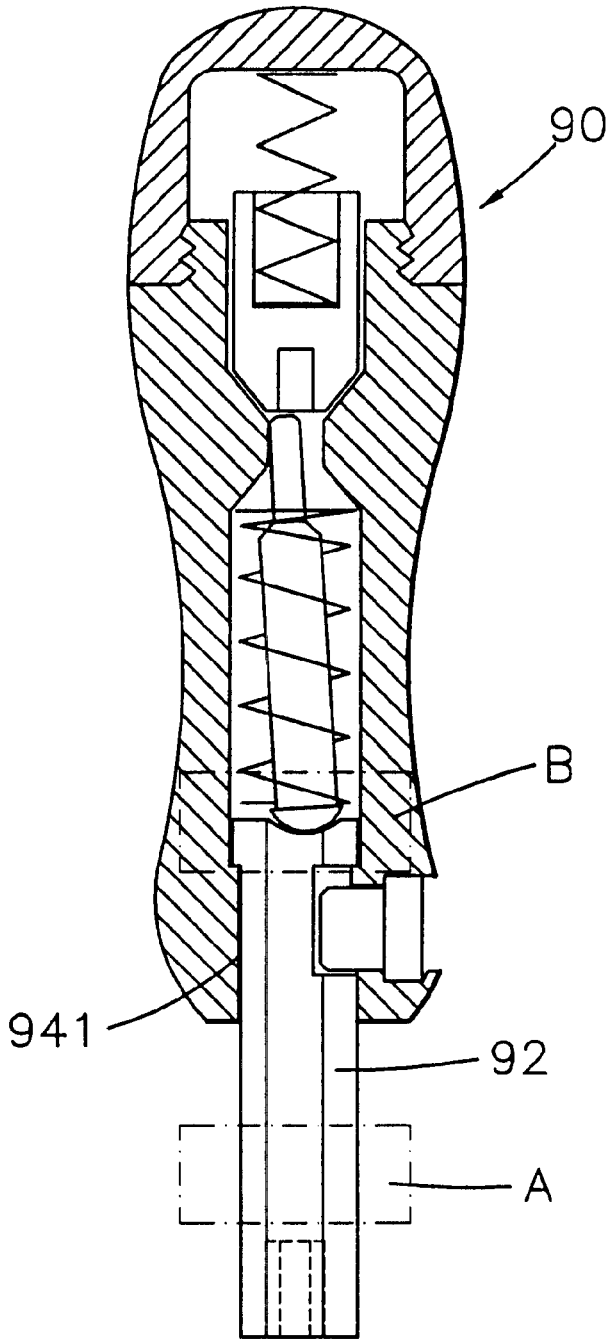
FIG. 17 is a sectional assembled view of an eighth embodiment of the present-invention.

FIG. 17 shows still another embodiment of the present invention, in which a ratchet mechanism is disposed on the stem body 92 as shown by phantom line A. Alternatively, a ratchet mechanism is disposed on the grip 90 corresponding to the stem body as shown by phantom line B. The ratchet mechanisms A, B pertain to prior art and will not be further described herein. Accordingly, the screwdrivers of the above embodiments has a ratchet effect. In the case that the ratchet mechanism is disposed in the grip 90 as the ratchet mechanism B, the torque which the grip and the stem body suffer is bridged by the ratchet mechanism B and no torque-suffering state exists between the hole 941 of the bottom end of the passage 94 and the stem body 92.

Figure 18:
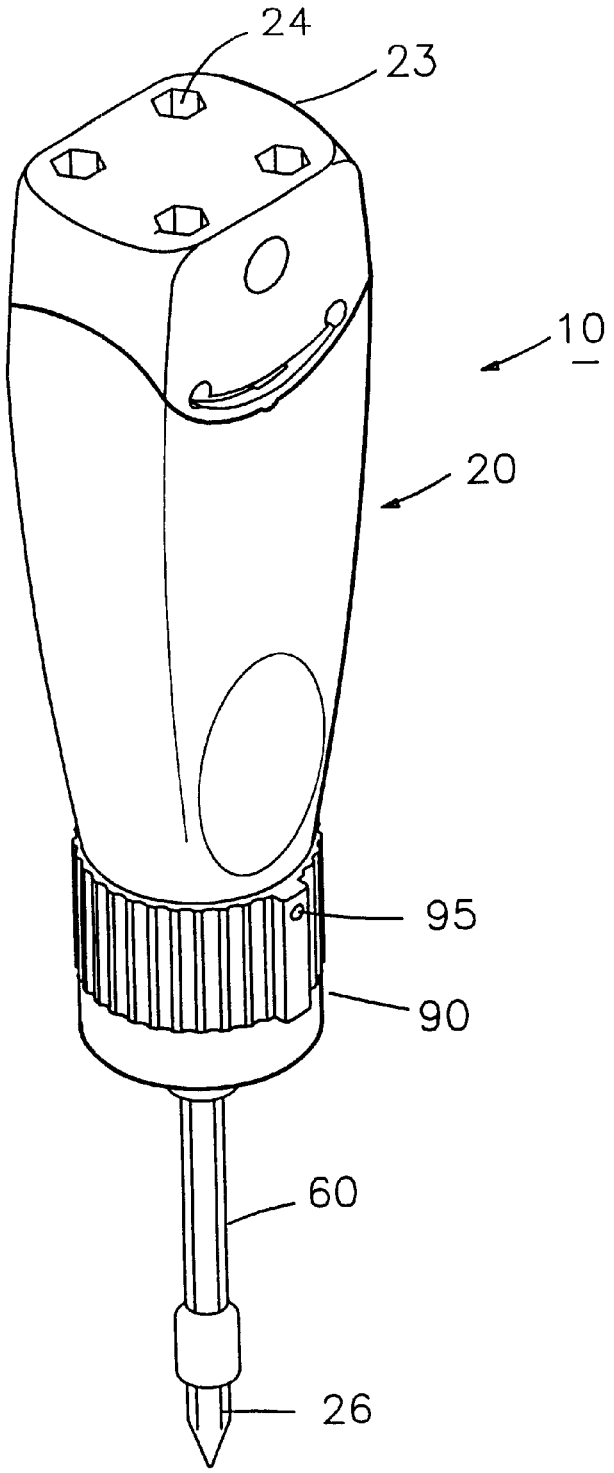
FIG. 18 is a perspective view of a ninth embodiment of the present invention.
Figure 19:
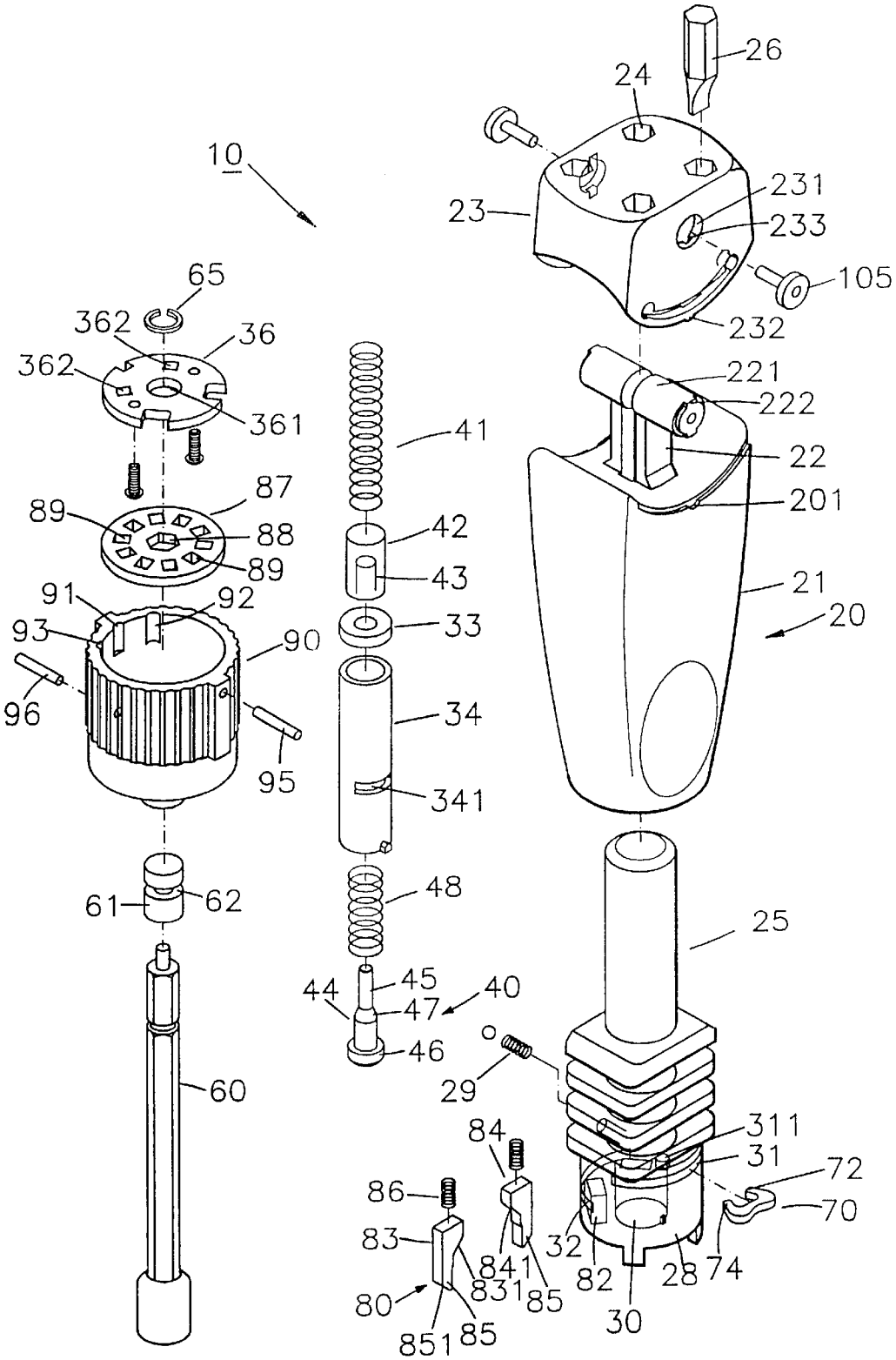
FIG. 19 is a perspective exploded view of the ninth embodiment of FIG. 18.
Figure 20:
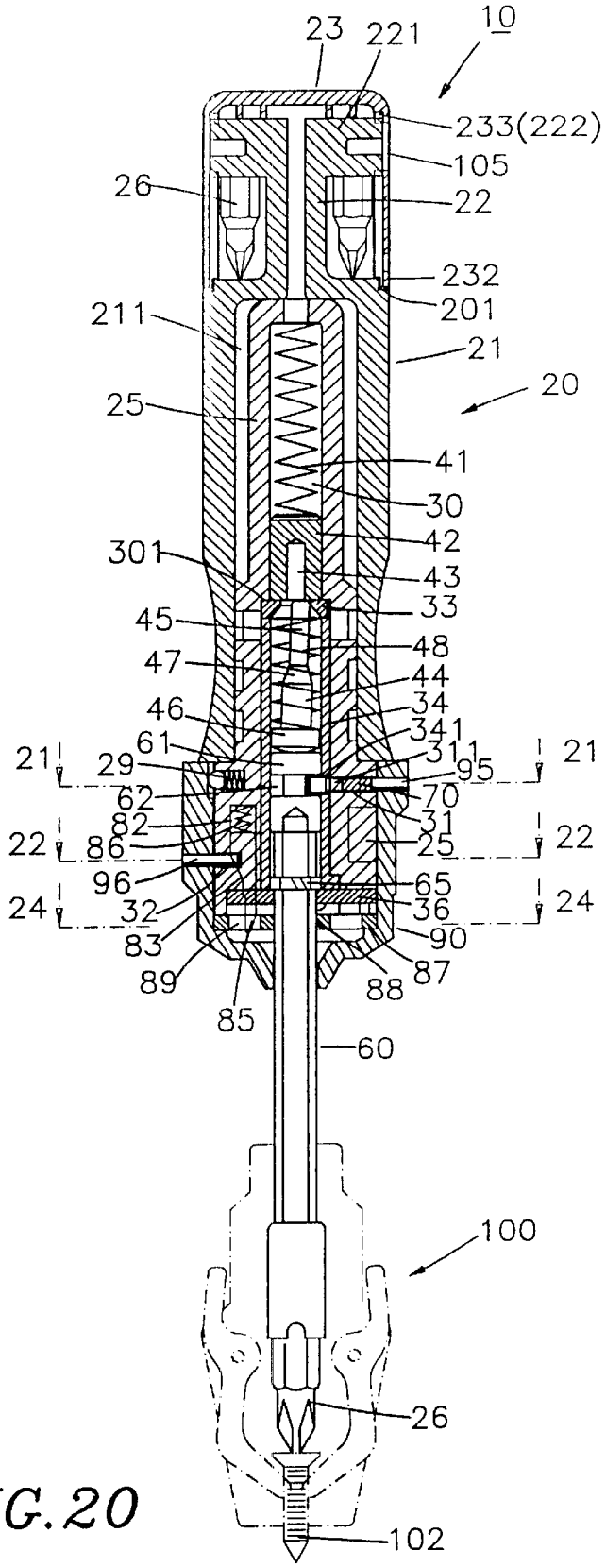
FIG. 20 is a longitudinal sectional view according to FIG. 18.
Figure 21:
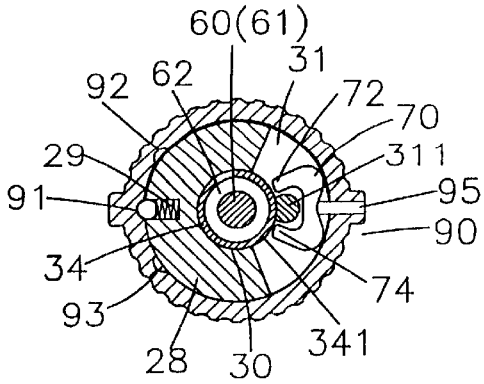
FIG. 21 is a sectional view taken along line 21—21 of FIG. 20.
Figure 22:
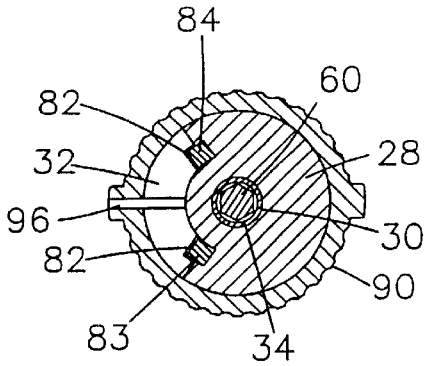
FIG. 22 is a sectional view taken along line 22—22 of FIG. 20.
Figure 24:
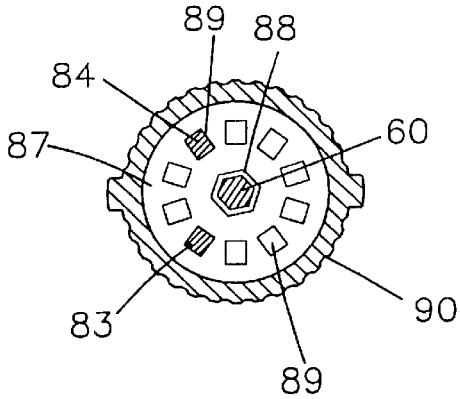
FIG. 24 is a sectional view taken along line 24—24 of FIG. 20.
Figure 23:
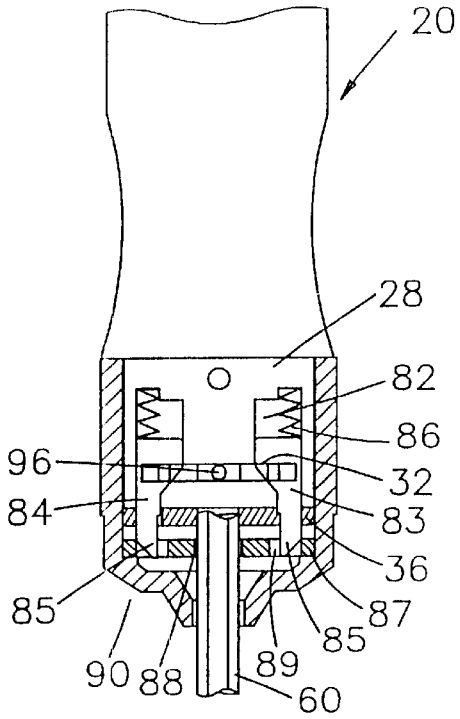
FIG. 23 is a longitudinal sectional view showing that the ratchet mechanism is disposed in the grip.

FIGS. 18, 19 and 20 show a ninth embodiment of the present invention, in which the screwdriver 10 includes:

a grip 20 including an outer grip 21 and an inner grip 25 and a rotary cap 23, the rotary cap 23 being formed with a cavity inward extending from bottom face of the rotary cap 23, multiple receptacles 24 being formed in the cavity for receiving various kinds of screwdriver heads 26 such as flat, cross-shaped, plum blossom-shaped and star-shaped screwdriver heads, two sides of the rotary cap being formed with through holes 231 for pivotally connecting the rotary cap with two cylindrical sections 221 of two resilient ribs 22 projecting from the top end of the outer grip 21 side by side, the body of the inner grip 25 being fixedly inserted in a fitting hole 211 of the outer grip 21 by way of tight fit, a head section 28 of bottom end of the inner grip 25 protruding out of the outer grip, the inner grip 25 being formed with an axial passage 30 passing through the bottom end of the inner grip, the head section 28 being formed with two radial slots, the first slot 31 inward extending and communicating with the passage 30 as shown in FIG. 21, a ring body 33 being received in the passage 30 and located at a shoulder section 301, a sleeve body 34 being fitted in the passage 30, the circumference of the sleeve body 34 being formed with a cut 341 aligned with the first slot 31, an end cap 36 being fixed disposed at bottom end of the head section 28 to locate the ring body 33 and the sleeve body 34 in the passage 30; and a striking mechanism 40 disposed in the passage 30 for providing a striking force, the striking mechanism 40 being substantially identical to the above striking mechanism, including:

a resilient energy-reserving member 41 having a relatively great coefficient of resilience;

a hammering body 42, a bottom end of the hammering body being formed with an inward extending shaft hole 43, the hammering body 42 being slidably received in the passage and resiliently pushed by the energy-reserving member 41, whereby the bottom end of the hammering body is located at a locating section formed by the ring body 33;

a hammering bar 44, a top end of the hammering bar being a rod section 45 with smaller diameter, while a bottom end of the hammering bar 44 being a striking section 46, an inclined guide section 47 being disposed between the rod section 45 and the striking section 46, the hammering bar 44 being slidably received in the passage 22 under the hammering body 42, a resilient member 48 being fitted on the hammering bar 44 for downward pushing the hammering bar 44, whereby in a normal state, the hammering bar will naturally tilt and the rod section 45 will contact with the bottom end of the hammering body 42 without extending into the shaft hole 43 thereof;

a stem body 60 having a polygonal cross-section, the top end of the stem body 60 being formed with a groove-like stop section 62, as shown in FIG. 19, the stop section 62 being formed on a member 61 which is fixedly connected with the top end of the stem body, the top end of the stem body 60 extending through the through hole 361 of the end cap 36 into the passage 30 and being telescopically slidable along the passage 30, the top end of the stem body 60 con contacting with the bottom end of the hammering bar 44, in a normal state, the engaging section 62 being right aligned with the first slot 31 and the cut 341 as shown in FIGS. 20, 21, the body of the stem body being clipped by a C-shaped latch member 65 for engaging with the end cap 36 to prevent the stem body from dropping out of the inner grip 25;

an engaging member 70 which is a substantially U-shaped plate body, two engaging sections 72, 74 respectively outward projecting from two sides of the body of the engaging member 70, the engaging member 70 being received in the first slot 31, the body of the engaging member 70 being stopped by a post-like stop section 311 disposed in the slot 31 and located as shown in FIG. 21, the engaging member being shiftable to change its position, whereby the engaging sections 72, 74 are positioned in the slot 31 or extend into the passage 30;

a ratchet mechanism 80 including: two tunnels 82 axially formed in the head section 28 and communicating with the second slot 32 as shown in FIG. 22; two detents 83, 84 each having a ratchet 85 at bottom end, the detents 83, 84 being slidably received in the two tunnels 82; two resilient members 86 respectively disposed in the tunnels 82 as shown in FIG. 23 for resiliently pushing the detents, whereby in a not forced state, the detents are kept sliding downward, when the detents are resiliently pushed, the wider bodies thereof being stopped in the tunnels without detaching therefrom, the ratchet 85 downward protruding out of the end cap 36 from the through hole 362 thereof; and an engaging disc 87 which is formed with a central polygonal engaging hole 88, multiple engaging perforations 89 being formed along the outer circumference of the engaging hole 88 at equal intervals, the engaging disc 87 being received in a barrel 90 and located right under the head section 28, the stem body 60 extending through the engaging hole 88 as shown in FIGS. 23, 24 and engaging with the engaging hole 88 as shown in FIG. 24, the ratchets 85 of the detents being engaged in two engaging perforations 89; and a rotary controlling member which is the above barrel 90, the barrel 90 being fitted on the head section 28 for locating the engaging disc 87 under the head section and keeping the engaging disc 87 drivingly connected with the stem body and the detents, the barrel 90 being rotatable around the outer circumference of the head section 28, the inner circumferential wall of the barrel being disposed with three locating sections 91, 92, 93, a locating assembly 29 embedded in the head section 28 abutting against the locating sections to locate the barrel, two driving sections 95, 96 which are insertion pins in this embodiment; being inserted in the circumferential wall of the barrel and projecting from the inner circumferential face of the barrel, the first driving section 95 extending into the first slot 31 as shown in FIG. 21 for driving the engaging member 70, the second driving section 96 extending into the second slot 32 as shown in FIG. 22 for driving the two detents 83, 84.

FIG. 20 shows the use of this embodiment. A suitable screwdriver head 26 is installed at the front end of the stem body 60 and aligned with a self-tightening screw 102. A screw-clamping mechanism 100 can be additionally mounted on the system body as shown by the phantom line for clamping the self-tightening screw, whereby the self-tightening screw is struck by the screwdriver 10 and nailed into the screwing position. The clamping mechanism 100 is not the subject of this invention and thus will not be further described herein.

When it is desired to strike the self-tightening screw, the barrel 90 is first turned to a first position as shown in FIG. 21, whereby the first locating section 91 is located by the locating assembly 29. At this time, the engaging member 70 is driven by the first driving section 95 to the central position where the two engaging sections 72, 74 will not extend into the passage 30, whereby the stop section 62 of the stem body 60 is not engaged with the engaging member 70 and is slidable. Also, as shown in FIGS. 22 and 23, the second driving member 96 is positioned between the two detents 83, 84 without driving any of them. At this time, both the ratchets 85 of the detents are engaged in two engaging perforations 89 of the engaging disc 87 as shown in FIGS. 23, 24 so that the engaging member cannot be rotated. Also, the circumference of the stem body 60 is engaged in the engaging hole 88 of the engaging disc 87 without rotating. Therefore, at this time, the ratchet mechanism 80 is unable to provide a ratchet effect.

Figure 25:
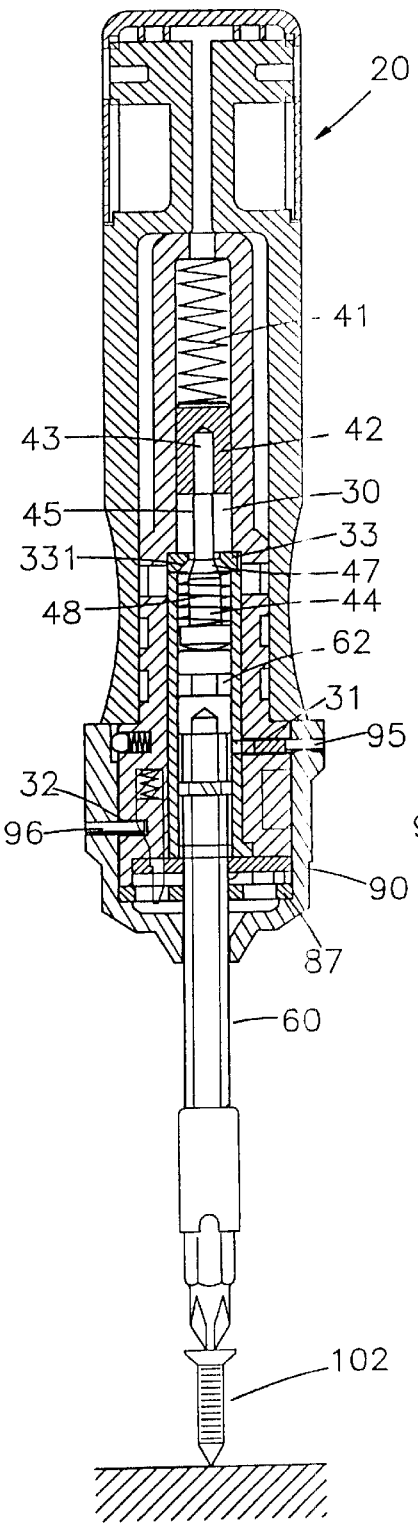
FIGS. 25 and 26 are longitudinal sectional view according to FIG. 20, showing the striking state thereof.

Then, as shown in FIG. 25, the tip of the self-tightening screw 102 is pressed against the surface of the work piece and the operator further downward presses the screwdriver. At this time, the stem body 60 slides into the passage 30 and the hammering bar 44 and the hammering body 42 are driven to move into the passage 30 to compress the energy-reserving member 41 for reserving a resilient energy.

Figure 26:
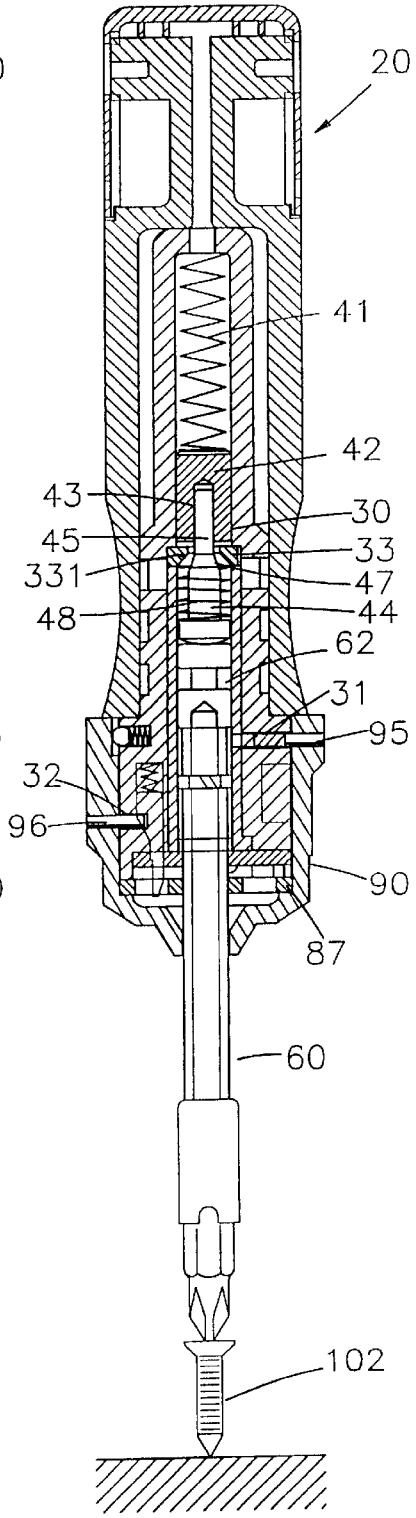

When the operator further exerts a force onto the screwdriver, the members 60, 44, 42 are further moved inward to increase the resilient energy reserved in the energy-reserving member 41. When the guide section 47 of the hammering bar 44 contacts with the rectifying section 331 formed by the bottom edge of the inner hole of the ring body 33, the hammering bar is guided to gradually deflect to an upright position. In the instant of alignment of the rod section 45 with the shaft hole 43 of the hammering body 42, the hammering body is free from the pushing force of the hammering bar 44 and the hammering bar is inserted into the hammering body. In this instant, the resilient energy of the energy-reserving member 41 is instantaneously released to act on the hammering body. At this time, the hammering body instantaneously strikes the hammering bar 44 as shown in FIG. 26. The impacting force acts on the stem body 60, making the tip of the self-tightening screw 102 nailed into the work piece.

When the screwdriver is released from the pressing force, the grip 20 is slightly moved upward and the resilient member 48 downward pushes the hammering bar 44 and the stem body 60, whereby the striking mechanism 40 is restored to a state as shown in FIG. 20.

The operation of FIGS. 20, 25 and 26 is repeated several times so as to truly and fixedly nail the tip of the self-tightening screw into the work piece by a certain depth.

Figure 29:
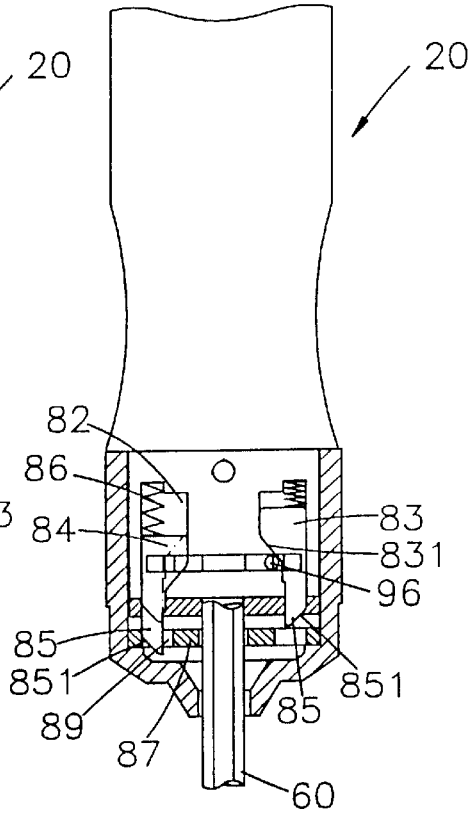
Figure 27:
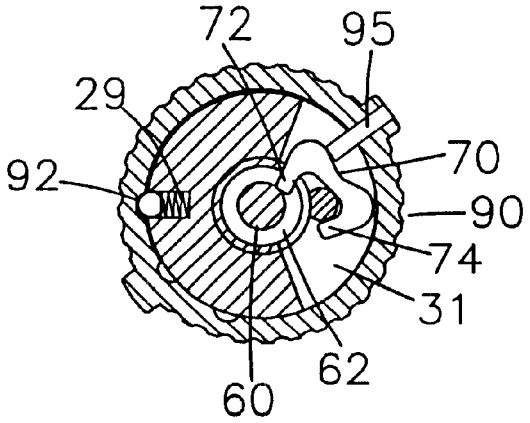
FIGS. 27 and 28 are cross-sectional view according to FIG. 21, showing that the stem body is engaged.

After the self-tightening screw is nailed, the barrel 90 is turned to the second position as shown in FIG. 27 where the second locating section 92 is located by the locating assembly 29. At this time, the engaging member 70 is driven by the first driving section 95 and deflected, making the first engaging section 72 extend into the passage 30 to engage with the stop section 62 of the stem body 60. At this time, the stem body is engaged and fixed without sliding and the stem body can exert an axial force onto the self-tightening screw. Also, when the barrel is located at the second position, as shown in FIG. 29, the second driving section 96 pushes an inclined push section 831 disposed on the body of the first detent 83, making the detent 83 slide into the tunnel 82. At this time, the ratchet 85 is moved out of the engaging perforation 89 of the engaging disc 87 and only the ratchet 85 of the second detent 84 remains engaged in the engaging perforation of the engaging disc. Therefore, the first detent 83 is unable to act on the engaging disc 87.

The state of FIG. 29 provides a one-way ratchet effect. According to the direction of the drawing, when the engaging disc 87 is moved left, the ratchet 85 (vertical face thereof) of the second detent 84 will be engaged in the engaging perforation 89, we preventing the engaging disc from moving toward left corner. Accordingly, under such circumstance, when the grip is turned, the engaging disc 87 will drive the stem body 60 to rotate for screwing the screw. Reversely, when the engaging disc is moved right, the engaging perforation 89 thereof will push the inclined face 851 of the ratchet 85 of the detent 84, making the detent 84 slide into the tunnel 82 as shown by the phantom line. At this time, the ratchet of the detent is disengaged from the engaging perforation 89, permitting the engaging disc to move toward the right corner. Under such circumstance, when turning the grip, the engaging disc 87 will idle and the stem body cannot drive the screw.

Figure 30:
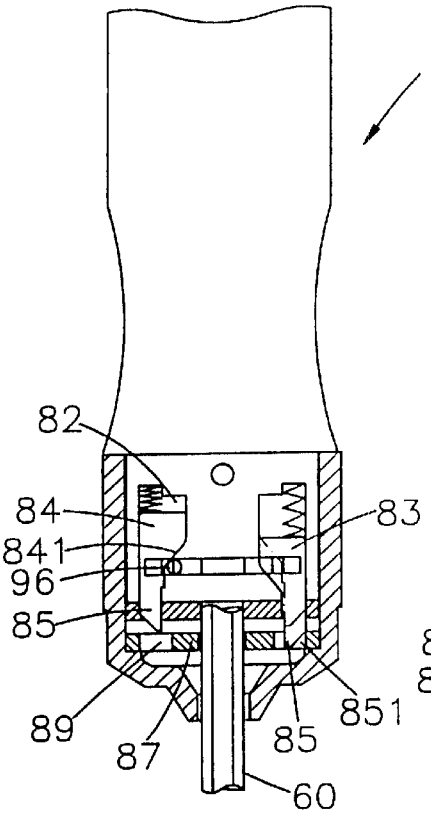
FIGS. 29 and 30 are longitudinal sectional view according to FIG. 23, showing that the ratchet mechanism: provides a ratchet effect.
Figure 28:
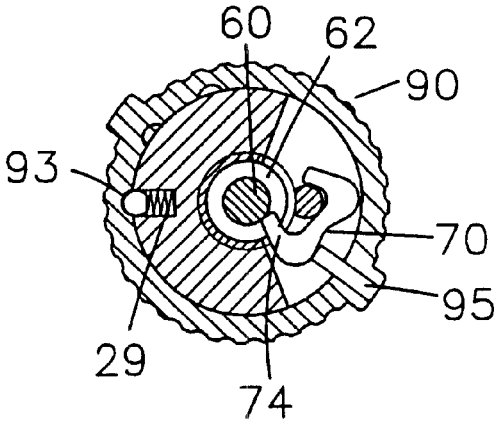

When the barrel 90 is rotated to the third position, as shown in FIG. 28, the third locating section 93 is located by the locating assembly 29. At this time, the engaging member 70 is driven and deflected by the first driving section 95 and the second engaging section 74 is engaged with the stop section 62 of the stem body 60 for fixing the stem body. Also, the second driving section 96 as shown in FIG. 30 pushes the inclined push section 841 of the second detent 84, making the detent 84 slide into the tunnel 82. At this time, the ratchet 85 of the detent is disengaged from the engaging perforation 89 of the engaging disc and only the ratchet 85 of the first detent 83 remains engaged in the engaging disc.

The state of FIG. 30 provides a one-way ratchet effect in another direction. When the engaging disc 87 is moved right, the ratchet 85 of the first detent 83 will be engaged in the engaging perforation 89, preventing the engaging disc from moving toward right corner. Accordingly, under such circumstance; when the grip is turned, the stem body 60 can screw the screw. Reversely, when the engaging disc is moved left, the engaging perforation 89 thereof will push the inclined face 851 of the ratchet 85 of the detent 83, making the detent 83 slide into the tunnel 82 as shown by the phantom line. At this time, the engaging disc can move toward the left corner. Under such circumstance, when turning the grip, the engaging disc 87 will idle and the stem body cannot drive the screw.

By means of the above one-way ratchet effect, the screwdriver can tighten or untighten the screw.

Figure 31:
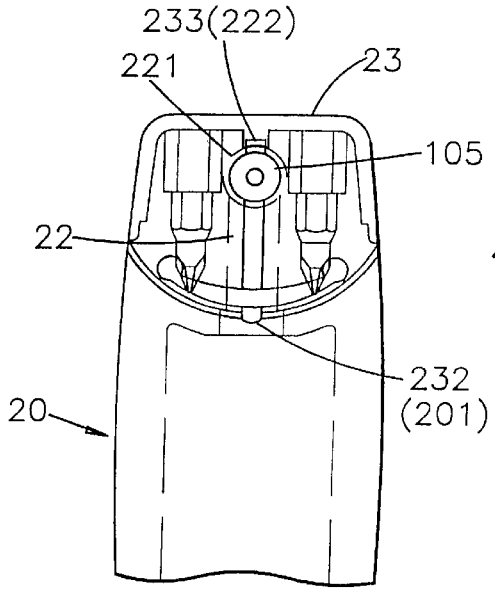
FIG. 31 is a side view of a part of the embodiment of FIG. 18.
Figure 32:
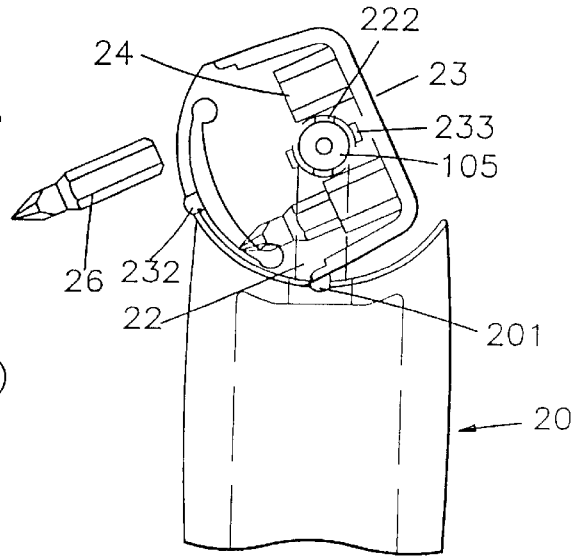
FIG. 32 is a view according to FIG. 31, showing that rotary cap is turned for replacing a screwdriver head.

Multiple shapes and sizes of screwdriver heads 26 are loaded in the rotary cap 23 disposed on the grip 20 as shown in FIG. 31 for a user to choose. When replacing the screwdriver head, the rotary cap 23 is turned left or right and opened as shown in FIG. 32 to expose the bottom opening of the rotary cap. Then, a necessary screwdriver head 26 is taken out from the receptacle 24 to fit with the bottom end of the stem body for use. Thereafter, the rotary cap is turned back to the close position as shown in, FIG. 31 and located. There can be two types of fixing structures for the rotary cap. One includes a projecting section 232 formed on the bottom edge of the rotary cap and a recessed section 201 formed on the top edge of the grip 20. The projecting section 232 is latched in the recessed section 201 to locate the rotary cap. The other is such that, as shown in FIG. 31, the edge of the end of each cylindrical section 221 is disposed with several projections 222, while the circumference of the through hole 231 of the rotary cap is disposed with several recesses 233. Two press buttons 105 are inserted with the cylindrical sections 221 from outer sides of the through hole. When the rotary cap 23 is positioned in a close position, the projections 222 are engaged in the recesses 233. When it is desired to turn open the rotary cap, the two press buttons 105 are pressed inward to inward deflect the two resilient ribs 22. At this time, the projections 222 are disengaged from the recesses 233 of the rotary cap, permitting the rotary cap to be turned open. When the rotary cap is turned back, the ribs 22 are resiliently restored to again fix the rotary cap.

FIGS. 33 to 36 show a tenth embodiment which is substantially identical to that of FIG. 21. Only the barrel, engaging member and stem body of this embodiment are shown. The other components of this embodiment are identical to those of the ninth embodiment.

Figure 33:
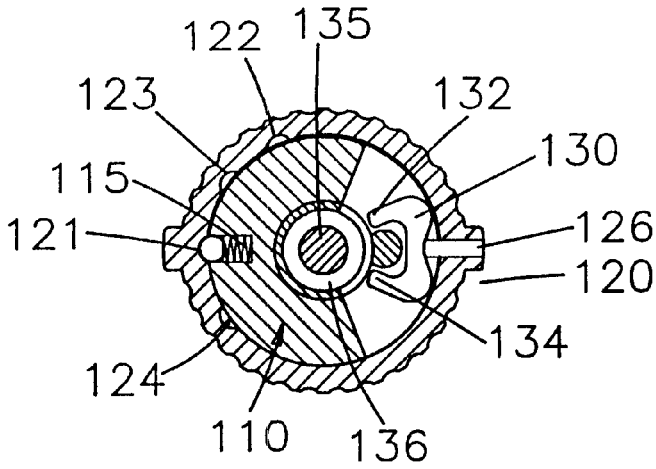
FIGS. 33 to 36 are cross-sectional views according to FIG. 21, showing the operation of a part of the tenth embodiment of the present invention.

In this embodiment, the barrel 120 has four stages of locating positions. When the first locating section 121 of the barrel is located by the locating assembly 115 in the grip 110 as shown in FIG. 33, the engaging member 130 is located by the first driving section 126 at the center. At this time, the two engaging sections 132, 134 of the engaging member are disengaged from the stop section 136 of the stem body 135 so that the stem body 135 can slide into the grip for providing a striking effect. The second driving section of the barrel will not drive the two detents so that no ratchet effect is provided.

Figure 34:
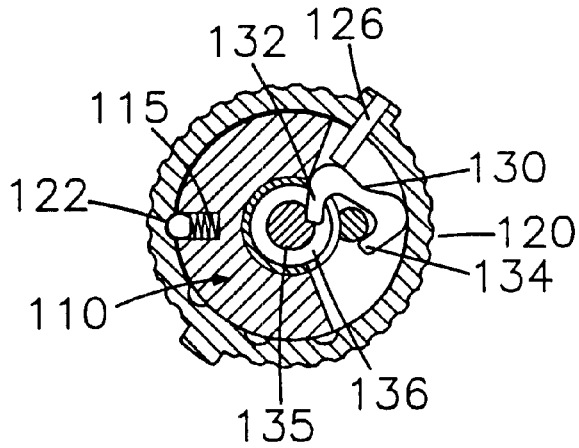

When the second locating section 122 of the barrel 120 is located by the locating assembly 115 as shown in FIG. 34, the engaging member 130 is driven and deflected by the first driving section 126, whereby the first engaging section 132 is engaged with the stop section 136 of the stem body 135. At this time, the stem body cannot move inward and is unable to provide a striking effect. Also, the second driving section of the barrel will not drive the two detents so that no ratchet effect is provided. At this time, the stem body can exert an axial force onto the screw and when the grip 110 is turned in any direction, the stem body is synchronously rotated to tighten or untighten the screw.

Figure 35:
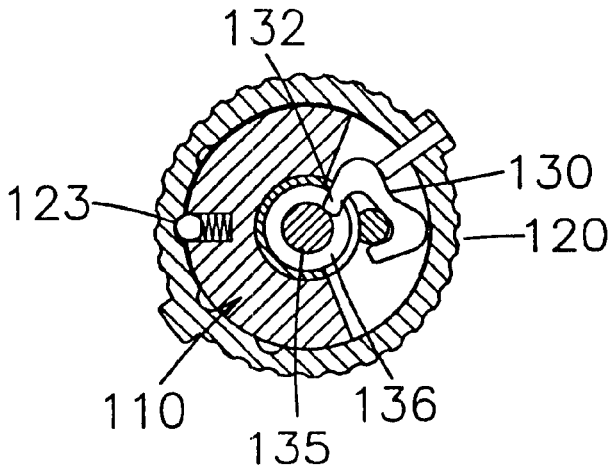

When the third locating section 123 of the barrel 120 is located by the locating assembly 115 as shown in FIG. 35, the first engaging section 132 of the engaging member 130 is still engaged with the stop section 136 of the stem body 135 so that the stem body cannot provide a striking effect. Also, the second driving section of the barrel will drive one of the detents to provide a one-way ratchet effect.

Figure 36:
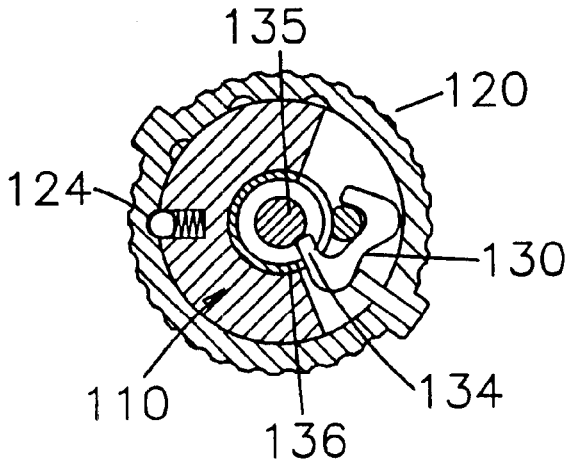

When the fourth locating section 124 of the barrel 120 is located by the locating assembly 115 as shown in FIG. 36, the second engaging section 134 of the engaging member 130 is engaged with the stem body 135 so that the stem body cannot provide a striking effect. Also, the second driving section of the barrel will drive the other of the detents to provide a one-way ratchet effect in another direction.

Figure 37:
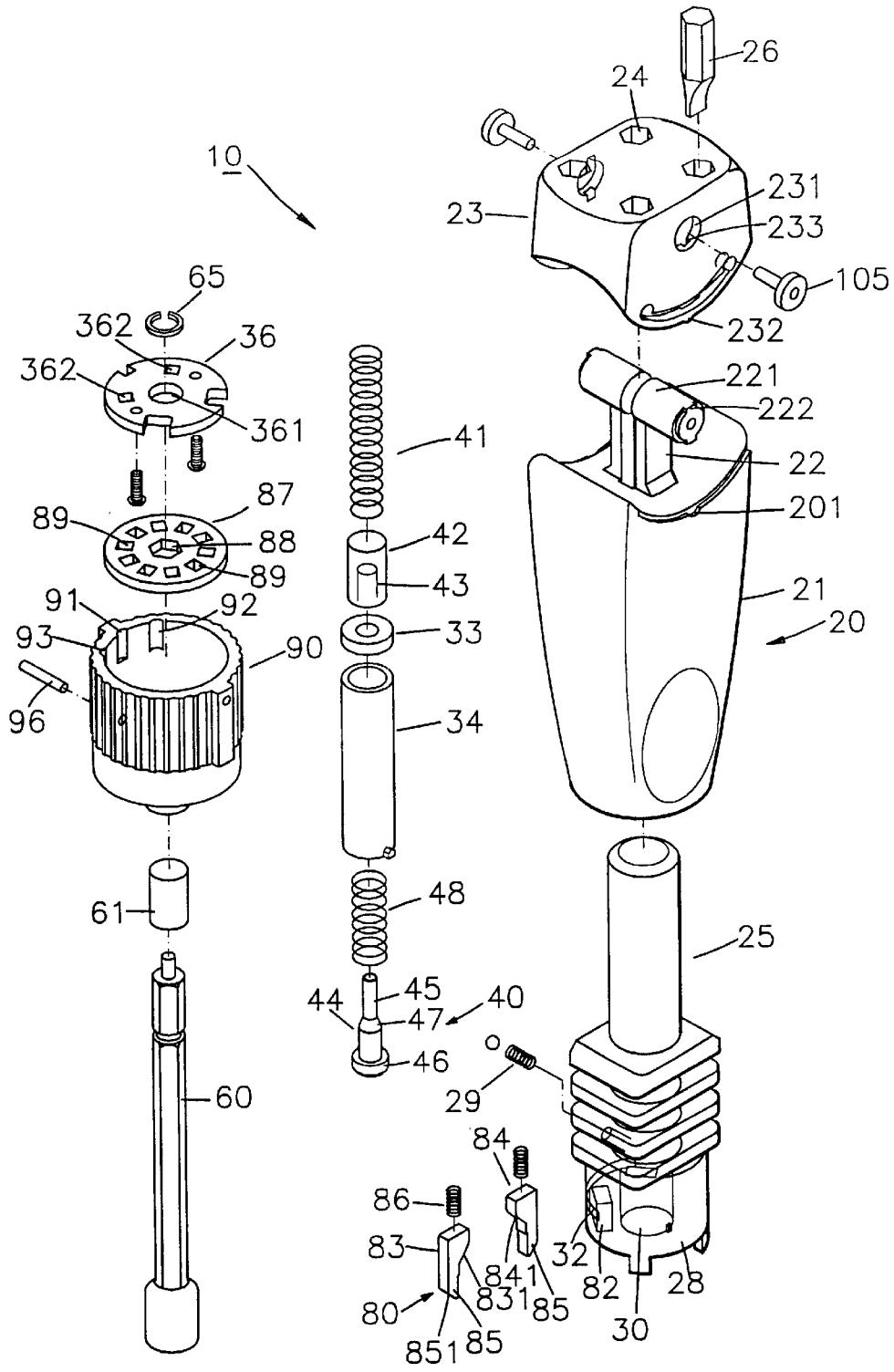
FIG. 37 is a perspective exploded view of an eleventh embodiment of the present invention.
Figure 38:
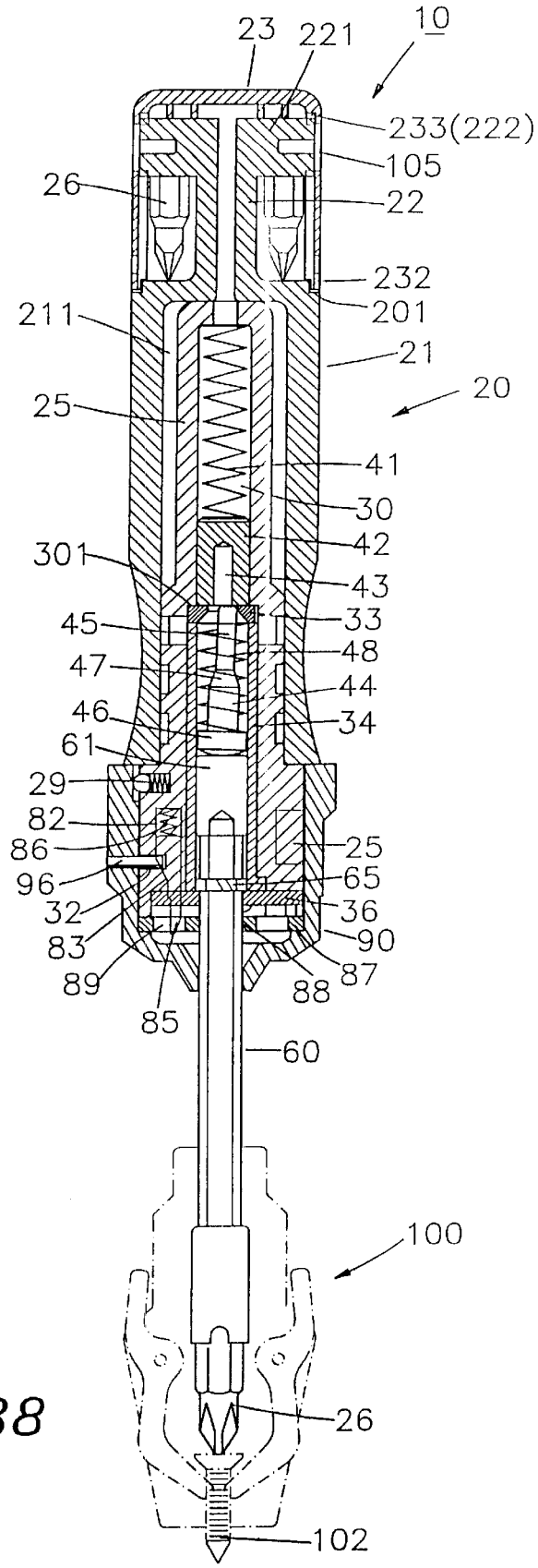
FIG. 38 is a longitudinal sectional assembled view of the eleventh embodiment of FIG. 37.

FIGS. 37 and 38 show an eleventh embodiment of the present invention, which is almost entirely identical to the ninth embodiment and only little difference exists therebetween.

In this embodiment, the grip 20 is free from the first slot 31 and the stop section 311, the sleeve body 34 is free from the cut, 341, the stem body 60 is free from the stop section 62 and the barrel 90 is free from the driving section 95 and the engaging member 70.

In use, as shown in FIG. 38, in a not striking state, the screwdriver 10 can still drive the self-tightening screw 102. Even if the screwdriver of this embodiment is in the striking state as shown in FIG. 26, it can be still used to screw the self-tightening screw.

The present invention has the following functions:

1. The primary function of the, screwdriver of the present invention is to nail the self-tightening screw at a screwing position. Therefore, the screwdriver of the present invention has double effects of nailing the screw and screwing the screw. After the self-tightening screw is nailed, the self-tightening screw can be screwed. This is convenient to a user.
2. The nailing of the self-tightening screw is directly achieved by the screwdriver without using any other hammering tool and without pinching the self-tightening screw with a hand. Therefore, the hand is protected from being hit and injured by the hammering tool and the safety in operation can be ensured. Moreover, the present invention enables a user to screw the self-tightening screw with one single hand so that the operation is facilitated.

In addition, the screwdriver of the present invention is able to provide a striking effect so that a suitable tool can be installed at the front end of the stem body to provide a punching effect.

The above embodiments are only used to illustrate the present invention, not intended to limit the scope thereof. Many modifications of the above embodiments can be made without departing from the spirit of the present invention.

What is claimed is:

1. Screwdriver for operating a self-tightening screw, comprising:

a grip for a user to hold, the grip being formed with an axial passage passing through a bottom end of the grip;

a striking mechanism disposed in the passage for providing a striking force acting onto the bottom end of the grip; and a step body, a top end of the stem body being slidably disposed in the passage without dropping out, a bottom end of the stem body protruding out of the grip for engaging with a self-tightening screw, a torque being transmitted between the stem body and the grip, the top end of the stem body being drivingly connected with the striking mechanism, a striking force provided by the striking mechanism acting on the stem body, wherein an inner side of the top end of the stem body has a stop section, the screwdriver further comprising a stop member having an engaging section, the stop member being disposed on a circumferential face of the grip and movable between two positions, whereby when the stop member is positioned at a first position, the engaging section is engaged with the stop section to locate the stem body, while when the stop member is positioned at a second position, the stop section is disengaged from the engaging section, permitting the stem body to slide, whereby, when the self-tightening screw is engaged with the stem body and the screwdriver is pressed downward against the self-tightening screw, making the self-tightening screw and the stem body move toward the passage, the striking mechanism provides the striking force which acts on the self-tightening screw to nail the self-tightening screw into a screwing position of a work piece and then the screwdriver can be turned to screw the self-tightening screw into the work piece.

2. Screwdriver for operating self-tightening screw as claimed in claim 1, wherein the striking mechanism includes an energy-reserving member disposed in the passage and a striking assembly slidably disposed in the passage, when the striking assembly suffers an external force to slide inward the passage, the energy-reserving member reserving a resilient energy which is transmitted to the striking assembly, after the striking assembly slides through a predetermined distance, the energy-reserving, member releasing the resilient energy to provide a downward striking force, in a not forced state, the striking assembly being positioned at a lower stop point of the sliding travel thereof.

3. Screwdriver for operating self-tightening screw as claimed in claim 1, wherein the circumferential face of the bottom end of the grip is formed with a window communicating with the passage, the engaging section extending from the window into the passage.

4. Screwdriver for operating self-tightening screw as claimed in claim 3, wherein the stop member is an arched plate body having an engaging section.

5. Screwdriver for operating self-tightening screw as claimed in claim 3, wherein the stop member is a ring body, an inner circumferential wall of the ring body being disposed with an engaging section, the stop member being fitted around the outer circumference of the grip for a user's hand to turn.

6. Screwdriver for operating self-tightening screw as claimed in claim 1, wherein the passage is formed with a hole at the bottom end of the grip, the hole having a cross-section with a shape corresponding to the shape of the cross-section of the stem body.

7. Screwdriver for operating self-tightening screw as claimed in claim 1, further comprising a ratchet mechanism disposed on the stem body to provide a ratchet effect for the screwdriver.

8. Screwdriver for operating self-tightening screw as claimed in claim 1, further comprising a ratchet mechanism disposed between the grip and the stem body to provide a ratchet effect for the screwdriver and serve as a torque transmitting mechanism between the grip and the stem body.

9. Screwdriver for operating self-tightening screw as claimed in claim 3, wherein the stop member is a rod member, a body of the stop member being formed with an engaging section, one end of the stop member extending from the window into the grip, while the other end thereof protruding outside the grip and being radially slidable, the stem body being passed through the stop member, a resilient member being disposed between the grip and the stop member for resiliently pushing the stop member outward from the grip in a not forced state, whereby the engaging section is engaged with the stop section of the stem body.

10. Screwdriver for operating self-tightening screw as claimed in claim 3, wherein the grip is formed with a radial cut and the stop member is a rod member passed through the radial cut of the grip and radially slidable, the stem body being passed through the stop member, the screwdriver further comprising a pressing lever the body of which is pivotally connected to the circumferential face of the grip and movable between two positions, one end of the pressing lever being connected with the stop member for driving the stop member to slide, the screwdriver further comprising a resilient member disposed between the pressing lever and the grip, when the pressing lever is not subject to external force, the resilient member serving to resiliently make the pressing lever keep the stop member at the first position for engaging with and locating the stem body, when the stop member is shifted to the second position, the stop member is disengaged from the stem body.

11. Screwdriver for operating self-tightening screw as claimed in claim 1, wherein the bottom end of the stem body is a screwdriver head.

12. Screwdriver for operating self-tightening screw as claimed in claim 1, wherein the bottom end of the stem body is formed with a socket in which a screwdriver head is fitted.

13. Screwdriver for operating self-tightening screw as claimed in claim 2, wherein the energy-reserving member is disposed at the top end of the passage, the striking assembly including: a hammering body disposed under the energy-reserving member and pushed thereby; and a hammering bar disposed under the hammering body, whereby when the striking assembly slides inward, the energy-reserving member is compressed and during the sliding, the relationship between the hammering body and the hammering bar is changed from an engaged state into an insertion state so as to release the resilient energy reserved in the energy reserving member.

14. Screwdriver for operating self-tightening screw as claimed in claim 13, wherein a bottom end of the hammering body is formed with an inward extending shaft hole and a top end of the hammering bar is a rod section with smaller diameter, in a normal state, the rod section being not fitted into the shaft hole, while after the striking assembly slides inward by a predetermined travel, the rod section being inserted into the shaft hole for releasing the resilient energy.

15. Screwdriver for operating self-tightening screw as claimed in claim 14, wherein the inner wall of the passage is formed with a guide section and the body of the hammering bar is formed with a rectifying section under the rod section on lower side of the guide section, the hammering bar being tilted in the passage rather than in an upright state, when the hammering bar pushes the hammering body to slide upward, the top end of the rod section abutting against the bottom end of the hammering body, when the guide section contacts with the rectifying section, the hammering bar being rectified into an upright state with the rod section aligned with the shaft hole for inserting therein to, a resilient member being disposed between the grip and the hammering bar for downward pushing the hammering bar, whereby when not forced, the hammering bar is restored to a state in which the hammering bar abuts against the hammering body.

16. Screwdriver for operating self-tightening screw as claimed in claim 15, wherein the diameter of the hammering bar is smaller than the inner diameter of the passage for tilting the hammering bar.

17. Screwdriver for operating self-tightening screw as claimed in claim 15, further comprising a tilting member disposed in the grip and resiliently abutting against the hammering bar, whereby prior to rectifying, the hammering bar is kept tilted.

18. Screwdriver for operating self-tightening screw as claimed in claiming 14, wherein the bottom end of the hammering body is formed with a radial tunnel communicating with the shaft hole, the screwdriver further comprising an aligning ember slidably fitted in the tunnel, a body of the aligning member being formed with a hole corresponding to the shaft hole, a resilient member being disposed between the hammering body and the aligning member for resiliently pushing the aligning member to slide outward from the tunnel and making the hole disaligned from the shaft hole, the rod section of the hammering bar abutting against the aligning member from the bottom end of the shaft hole, whereby after the hammering bar and the hammering body are moved upward by a predetermined distance, the aligning member is slided into the tunnel to make the hole aligned with the shaft hole, permitting the rod section to insert into the shaft hole.

19. Screwdriver for operating self-tightening screw as claimed in claim 18, wherein the wall face of the passage is formed with a rectifying section, one of the aligning member protruding out of the hammering body, whereby when the hammering body is moved upward and the aligning member contacts with the rectifying section, the aligning member is guided by the rectifying section to slide into the tunnel.

20. Screwdriver for operating self-tightening screw as claimed in claim 18, wherein the circumferential wall of the grip is formed with a slot corresponding to the up and down travel of the aligning member, one end of the aligning member protruding out of the grip from the slot for a user's hand to press and make the aligning member slide into the tunnel.

21. Screwdriver for operating self-tightening screw as claimed in claim 15, wherein the circumferential wall of the passage is disposed with a locating section above the guide section, the lower travel of the hammering body being located at the locating section, the resilient member making the hammering bar located at the lowers top point and making the rod section separate from the shaft hole.

22. Screwdriver for operating self-tightening screw comprising:

a grip formed with an axial passage passing through a bottom end of the grip;

a striking mechanism disposed in the passage for providing a striking force due to external force;

a stem body slidably disposed in the passage, a bottom end of the stem body protruding out of the grip, a top end of the stem body being drivingly connected with the striking mechanism, whereby when the stem body suffers a force to slide into the passage, the striking force provided by the striking mechanism acting on the stem body;

a rotary controlling member disposed on the grip for a user's hand to shift;

an engaging member disposed between the stem body and the rotary controlling member; and a ratchet mechanism disposed between the grip and the stem body, whereby when operating the rotary controlling member, the rotary controlling member is drivingly connected with the engaging member and the ratchet mechanism, the rotary controlling member cooperating with the engaging member to fix the stem body and prevent the stem body from being drivingly connected with the striking mechanism or disengage the stem body and control whether the ratchet mechanism provides a ratchet effect for the stem body.

23. Screwdriver for operating self-tightening screw as claimed in claim 22, wherein the rotary controlling member has two driving sections, the first driving section corresponding to the engaging member, while the second driving section corresponding to the ratchet mechanism, the first driving section controlling the shifting of the engaging member, making the engaging member engaged with the stem body or disengaged herefrom, the second driving section switching the ratchet mechanism between a ratchet effect-providing state and a not providing state.

24. Screwdriver for operating self-tightening screw as claimed in claim 22, wherein the engaging member is directly connected with the rotary controlling member and movable along therewith.

25. Screwdriver for operating self-tightening screw as claimed in claim 22, wherein the body of the stem body is disposed with a stop section, when the engaging member is moved to engage with the stop section, the stem body is located.

26. Screwdriver for operating self-tightening screw as claimed in claim 22, wherein the circumferential wall of the grip is formed with a radial first slot communicating with the passage, the body of the stem body being disposed with a stop section, in a natural state, when the stem body is not forced, the stop section being aligned with the first slot, the engaging member being movably disposed in the slot, the engaging member being driven by the rotary controlling member to extend into the passage and engage with the stop section or driven by the rotary controlling member to disengage from the stop section.

27. Screwdriver for operating self-tightening screw as claimed in claim 26, wherein the rotary controlling member is disposed with a first driving section positioned in the first slot for driving the engaging member to shift.

28. Screwdriver for operating self-tightening screw as claimed in claim 22, wherein the ratchet mechanism is disposed in the grip, the grip being formed with a second slot communicating with the interior of the ratchet mechanism, the rotary controlling member being disposed with a second driving section positioned in the second slot, when operating the rotary controlling member, the second driving section switching the ratchet mechanism between a ratchet effect-providing state and a not providing state.

29. Screwdriver for operating self-tightening screw as claimed in claim 22, wherein the grip is formed with a first and a second radial slots, the first slot communicating with the passage, the body of the stem body being disposed with a stop section corresponding to the first slot, the engaging member being disposed in the first slot, the ratchet mechanism being disposed in the grip, the second slot communicating with the ratchet mechanism, the stem body extending into the ratchet mechanism, whereby the ratchet mechanism provides a ratchet effect for controlling the operation of the stem body, the rotary controlling member having two driving section, the first driving section being positioned in the first slot for controlling the engaging member to engage with the stop section, the second driving section being positioned in the second slot for switching the ratchet mechanism between a ratchet effect-providing state and a not providing state.

30. Screwdriver for operating self-tightening screw as claimed in claim 26, wherein two sides of the body of the engaging member are respectively disposed with two engaging sections, when the engaging member is shifted to one position, the engaging sections being kept in the first slot without engaging with the stem body, when the engaging member is shifted to the other position, one of the engaging sections being engaged with the stop section of the stem body.

31. Screwdriver for operating self-tightening screw as claimed in claim 23, wherein the stem body has a polygonal cross-section, the ratchet mechanism including: two tunnels axially formed in the grip; two detents each having a ratchet at bottom end, the detents being slidably received in the two tunnels; two resilient members respectively disposed in the tunnels for resiliently pushing the detents, whereby in a not forced state, the detents are kept sliding downward; and an engaging disc which is formed with a central polygonal engaging hole, multiple engaging perforations being formed along the circumference of the engaging hole at equal intervals, the engaging disc being disposed under the detents, the stem body extending through the engaging hole to engage with the stem body, the ratchets of the detents being engaged in two engaging perforations of the engaging disc, the rotary controlling member having at least three shifting positions, whereby when the rotary controlling member is shifted to one of the positions, the second driving section will not drive the two detents and when the rotary controlling member is shifted to the other position, one of the detents is pushed upward and the ratchet thereof is disengaged from the engaging perforation of the engaging disc.

32. Screwdriver for operating self-tightening screw as claimed in claim 31, wherein the rotary controlling member is a barrel fitted on the grip.

33. Screwdriver for operating self-tightening screw as claimed in claim 22, wherein-the striking mechanism includes an energy reserving member disposed in the passage and a striking assembly slidably disposed in the passage, when the striking assembly is driven by the stem body to slide inwards the passage, the energy-reserving member reserving a resilient energy, after the striking assembly slides through a predetermined distance, the energy-reserving member releasing the resilient energy to provide a downward striking force which is transmitted from the striking-assembly to the stem body, in a not forced state, the striking assembly being positioned at a lower stop point of the sliding travel thereof.

34. Screwdriver for operating self-tightening screw as claimed in claim 33, wherein the striking assembly including: a hammering body disposed under the energy-reserving member and pushed thereby; and a hammering bar disposed under the hammering body to abut against the hammering body, whereby when the striking assembly slides inward, the energy-reserving member is compressed and during the sliding, the hammering body and the hammering bar is released from the engaged state so as to release the resilient energy.

35. Screwdriver for operating self-tightening: screw as claimed in claim 34, wherein a bottom end of the hammering body is formed with an inward extending shaft hole and a top end of the hammering bar is a rod section with smaller diameter, in a normal state, the rod section being not fitted into the shaft hole, while after the striking assembly slides inward by a predetermined travel, the rod section being inserted into the shaft hole for releasing the resilient energy.

36. Screwdriver for operating self-tightening screw as claimed in claim 35, wherein the inner wall of the passage is formed with a guide section and the body of the hammering bar is formed with a rectifying section under the rod section on lower side of the guide section, when the hammering bar pushes the hammering body to slide upward, the top end of the rod section abutting against the bottom end of the hammering body, when the guide section contacts with the rectifying section, the hammering bar being rectified into an upright state with the rod section aligned with the shaft hole for inserting therein to, a resilient member being disposed between the grip and the hammering bar for downward pushing the hammering bar, whereby when not forced, the hammering bar is restored to a state in which the hammering bar abuts against the hammering body.

37. Screwdriver for operating self-tightening screw as claimed in claim 31, wherein the grip includes an outer grip formed with a fitting hole and an inner grip having a head section at bottom end, the inner grip being fixedly disposed in the fitting hole, the head section being exposed outside the bottomend of the outer grip, the passage being formed in the inner grip, the ratchet mechanism and the rotary controlling member being disposed at the head section.

38. Screwdriver for operating self-tightening screw as claimed in claim 22, wherein at least two rib sections project from the top end of the grip, the screwdriver further comprising a rotary cap, the rotary cap being formed with a cavity inward extending from bottom face of the rotary cap, multiple receptacles being formed in the cavity for receiving various kinds of screwdriver heads, the rotary cap being pivotally connected with the rib sections.

39. Screwdriver for operating self-tightening screw comprising:

a grip formed with an axial passage passing through a bottom end of the grip;

a striking mechanism disposed in the passage for providing a striking force acting onto the bottom end of the grip due to external force;

a stem body slidably disposed in the passage, a bottom end of the stem body protruding out of the grip, a top end of the stem body being drivingly connected with the striking mechanism, whereby when the stem body suffers an external force to slide into the passage, the striking mechanism providing the striking force acting on the stem body;

a rotary controlling member disposed on the grip for a user's hand to shift; and a ratchet mechanism disposed between the grip and the stem body;

whereby when operating the rotary controlling member, the rotary controlling member is drivingly connected with the ratchet mechanism to control whether the ratchet mechanism provides a ratchet effect for the stem body.

40. Screwdriver for operating self-tightening screw as claimed in claim 39, wherein the rotary controlling member has a driving section, the driving section corresponding to the ratchet mechanism, the-driving section being drivingly connected with the ratchet mechanism to control the ratchet effect of the ratchet mechanism.

41. Screwdriver for operating self-tightening screw as claimed in claim 39, wherein the ratchet mechanism is disposed in the grip, the grip being formed with a slot communicating with the interior of the ratchet mechanism, the rotary controlling member being disposed with a driving section positioned in the slot, when operating the rotary controlling member, the driving section switching the ratchet mechanism between a ratchet effect-providing state and a not providing state.

42. Screwdriver for operating self-tightening screw as claimed in claim 39, wherein the ratchet mechanism is disposed in the grip, the stem body extending into the ratchet mechanism, whereby the ratchet mechanism provides a ratchet effect for controlling the operation of the stem body, the grip being formed with a radial slot communicating with the ratchet mechanism, the rotary controlling member having a driving section positioned in the slot for switching the ratchet mechanism between a ratchet effect-providing state and a not providing state.

43. Screwdriver for operating self-tightening screw as claimed in claim 40, wherein the stem body has a polygonal cross-section, the ratchet mechanism including: two tunnels axially formed in the grip; two detents each having a ratchet at bottom end, the detents being slidably received in the two tunnels; two resilient members respectively disposed in the tunnels for resiliently pushing the detents, whereby in a not forced state, the detents are kept sliding downward; and an engaging disc which is formed with a central polygonal engaging hole, multiple engaging perforations being formed along the circumference of the engaging hole at equal intervals, the engaging disc being disposed under the detents, the stem body extending through the engaging hole to engage with the stem body, the ratchets of the detents being engaged in two engaging perforations of the engaging disc, the rotary controlling member having at least three shifting positions, whereby when the rotary controlling member is shifted to one of the positions, the second driving section will not drive the two detents and the two detents are kept engaged with the engaging disc and when the rotary controlling member is shifted to the other position, one of the detents is pushed upward and the ratchet thereof is disengaged from the engaging perforation of the engaging disc.

44. Screwdriver for operating self-tightening screw as claimed in claim 39, wherein the rotary controlling member is a barrel fitted on the grip.

45. Screwdriver for operating self-tightening screw as claimed in claim 39, wherein the striking mechanism includes an energy-reserving member disposed in the passage and a striking assembly slidably disposed in the passage, when the striking assembly is driven by the stem body to slide inward the passage, the energy-reserving member reserving a resilient energy, after the striking assembly slides through a predetermined distance, the energy-reserving member releasing the resilient energy to provide a downward striking force which is transmitted from the striking assembly to the stem body, in a not forced state, the striking assembly being positioned at a lower stop point of the sliding travel thereof.

46. Screwdriver for operating self-tightening screw as claimed in claim 45, wherein the striking assembly including: a hammering body disposed under the energy-reserving member and pushed thereby; and a hammering bar disposed under the hammering body to abut against the hammering body, whereby when the striking assembly slides inward, the energy-reserving member is compressed and during the sliding, the hammering body and the hammering bar is released from the engaged state so as to release the resilient energy.

47. Screwdriver for operating self-tightening screw as claimed in claim 46, wherein a bottom end of the hammering body is formed with an inward extending shaft hole and a top end of the hammering bar is a rod section with smaller diameter, in a normal state, the rod section abutting against the bottom end of the hammering body and being not fitted into the shaft hole, while after the striking assembly slides inward by a predetermined travel, the rod section being inserted into the shaft hole for releasing the resilient energy.

48. Screwdriver for operating self-tightening screw as claimed in claim 47, wherein the inner wall of the passage is formed with a guide section and the body of the hammering bar is formed with a rectifying section under the rod section on lower side of the guide section, when the hammering bar pushes the hammering body to slide upward, the top end of the rod section abutting against the bottom end of the hammering body, when the guide section contacts with the rectifying section, the hammering bar being rectified into an upright state with the rod section aligned with the shaft hole for inserting therein to, a resilient member being disposed between the grip and the hammering bar for downward pushing the hammering bar, whereby when not forced, the hammering bar is restored to a state in which the hammering bar abuts against the hammering body.

49. Screwdriver for operating self-tightening screw as claimed in claim 39, wherein the grip includes an outer grip formed with a fitting hole and an inner grip fixedly disposed in the fitting hole, the passage being formed in the inner grip.

50. Screwdriver for operating self-tightening screw as claimed in claim 43, wherein the grip includes an outer grip formed with a fitting hole and an inner grip having a head section at bottom end, the inner grip being fixedly disposed in the fitting hole, the head section being exposed outside the bottomend of the outer grip, the passage being formed in the inner grip, the ratchet mechanism and the rotary controlling member being disposed at the head section.

51. Screwdriver for operating self-tightening screw as claimed in claim 39, wherein at least two rib sections project from the top end of the grip, the screwdriver further comprising a rotary cap, the rotary cap being formed with a cavity inward extending from bottom face of the rotary cap, multiple receptacles being formed in the cavity for receiving various kinds of screwdriver heads, the rotary cap being pivotally connected with the rib sections.

* * * * *